US009959798B2

(12) United States Patent
Kim et al.

(10) Patent No.: US 9,959,798 B2
(45) Date of Patent: May 1, 2018

(54) DISPLAY PANEL DRIVING APPARATUS FOR INCREASING GAMMA VALUE OF IMAGE DATA, METHOD OF DRIVING DISPLAY PANEL USING THE SAME AND DISPLAY APPARATUS HAVING THE SAME

(71) Applicant: SAMSUNG DISPLAY CO., LTD., Yongin-si, Gyeonggi-do (KR)

(72) Inventors: Yoon-Gu Kim, Seoul (KR); Bong-Im Park, Asan-si (KR); Ik-Hyun Ahn, Hwaseong-si (KR); Hyun-sik Hwang, Hwaseong-si (KR); Woo-Joo Lee, Seoul (KR); Jin-Young Lee, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 109 days.

(21) Appl. No.: 15/001,936

(22) Filed: Jan. 20, 2016

(65) Prior Publication Data

US 2017/0018255 A1 Jan. 19, 2017

(30) Foreign Application Priority Data

Jul. 16, 2015 (KR) ..... 10-2015-0101084

(51) Int. Cl.
*G09G 5/10* (2006.01)
*G09G 3/20* (2006.01)

(52) U.S. Cl.
CPC ..... *G09G 3/20* (2013.01); *G09G 2310/0251* (2013.01); *G09G 2310/08* (2013.01); *G09G 2320/0233* (2013.01); *G09G 2320/0673* (2013.01)

(58) Field of Classification Search
None
See application file for complete search history.

(56) References Cited

U.S. PATENT DOCUMENTS

2007/0040774 A1* 2/2007 Lee ..... G09G 3/3233 345/77
2010/0259551 A1* 10/2010 Kao ..... G09G 5/02 345/590
2015/0035866 A1 2/2015 Ahn et al.

FOREIGN PATENT DOCUMENTS

| | | |
|---|---|---|
| JP | 5427246 | 12/2013 |
| KR | 1020090013005 | 2/2009 |
| KR | 1020140078961 | 6/2014 |
| KR | 1020150015957 | 2/2015 |

* cited by examiner

*Primary Examiner* — Amr Awad
*Assistant Examiner* — Donna Lui
(74) *Attorney, Agent, or Firm* — F. Chau & Associates, LLC

(57) ABSTRACT

A display panel driving apparatus includes a data processing circuit, a data driver, and a gate driver. The data processing circuit increases a first gamma value of input image data of which the gamma value is 0, according to a second gamma value of the input image data of which the second gamma value is not 0. The data driving part outputs a data signal based on the output image data to a data line. The gate driving part outputs a gate signal to a gate line.

17 Claims, 15 Drawing Sheets

DISPLAY PANEL DRIVING APPARATUS FOR INCREASING GAMMA VALUE OF IMAGE DATA, METHOD OF DRIVING DISPLAY PANEL USING THE SAME AND DISPLAY APPARATUS HAVING THE SAME

CROSS-REFERENCE TO RELATED APPLICATIONS

This application claims priority under 35 U.S.C. § 119 to Korean Patent Application No. 10-2015-0101084, filed on Jul. 16, 2015 in the Korean Intellectual Property Office (KIPO), the disclosure of which is incorporated by reference in its entirety herein.

BACKGROUND

1. Technical Field

Exemplary embodiments of the present inventive concept relate to a display panel driving apparatus, a method of driving a display panel using the display panel driving apparatus, and a display apparatus having the display panel driving apparatus.

2. Discussion of Related Art

A display apparatus such as a liquid crystal display apparatus includes a display panel and a display panel driving apparatus. The display panel includes gate lines, data lines and pixels.

The display panel driving apparatus includes a gate driving part driving the gate lines, a data driving part driving the data lines, and a timing controlling part controlling a timing of the gate driving part and the data driving part.

The gate driving part outputs a first gate signal to a first gate line among the gate lines and outputs a second gate signal to a second gate line among the gate lines. A portion of an activation period of the first gate signal and a portion of an activation period of the second gate signal may overlap. The activation periods of each gate signal may include a pre-charge period and a main charge period. However, use of the pre-charge period may cause the luminance of the display apparatus at its sides to differ from one another, thereby reducing the quality of the display apparatus.

SUMMARY

At least one embodiment of the present inventive concept provides a display panel driving apparatus capable of improving display quality of a display apparatus.

At least one embodiment of the present inventive concept provides a method of driving a display panel using the above-mentioned display panel driving apparatus.

At least one embodiment of the present inventive concept provides a display apparatus having the above-mentioned display panel driving apparatus.

According to an exemplary embodiment of the present inventive concept, a display panel driving apparatus includes a data processing circuit, a data driver, and a gate driver. The data processing circuit is configured to increase a first gamma value of input image data of which the first gamma value is 0, according to a second gamma value of the input image data of which the second gamma value is not 0, to output image data including first output data, second output data and third output data. The data driver is configured to output a data signal based on the output image data output to a data line of a display panel. The gate driver is configured to output a gate signal to a gate line of the display panel.

In an exemplary embodiment, the input image data includes red input data, green input data, and blue input data, and the first output data is red output data, the second output data is green output data, and the third output data is blue output data.

In an exemplary embodiment, the input image data includes first through third input data, and when a gamma value of the first input data is 0, a gamma value of the second input data is 0 and a gamma value of the third input data is not 0, the data processing circuit increases the gamma value of the first input data according to the gamma value of the third input data.

In an exemplary embodiment, the data processing circuit increases the gamma value of the first input data such that the gamma value of the first input data increases according to an increase of the gamma value of the third input data.

In an exemplary embodiment, the input image data includes first through third input data, and when a gamma value of the first input data is 0, a gamma value of the second input data is not 0 and a gamma value of the third input data is not 0, the data processing circuit increases the gamma value of the first input data according to the gamma value of the second input data and the gamma value of the third input data.

In an exemplary embodiment, the data processing circuit increases the gamma value of the first input data such that the gamma value of the first input data increases according to an increase of the gamma value of the second input data and the gamma value of the third input data.

In an exemplary embodiment, the input image data includes first through third input data, and when a gamma value of the first input data is 0, a gamma value of the second input data is 0 and a gamma value of the third input data is 0, the data processing part may do not increase the gamma value of the first input data.

In an exemplary embodiment, the data processing circuit include a first data processing circuit configured to receive the input image data and output the first output data, a second data processing circuit configured to receive the input image data and output the second output data, and a third data processing circuit configured to receive the input image data and output the third output data.

In an exemplary embodiment, the input image data includes first through third input data, and the first data processing circuit includes a first boosting circuit increasing a gamma value of the first input data according to a gamma value of the second input data and a gamma value of the third input data to output first boost data, when the gamma value of the first input data is 0.

In an exemplary embodiment, the first boosting circuit includes a first address generator configured to receive the input image data and output a first address signal according to the gamma value of the second input data and the gamma value of the third input data when the gamma value of the first input data is 0, and a first register having entries configured to store gamma values and corresponding addresses and output one of the gamma values according to the first address signal, as the first boost data.

In an exemplary embodiment, the input image data includes first through third input data, and the second data processing part includes a second boosting circuit increasing a gamma value of the second input data according to a gamma value of the first input data and a gamma value of the third input data to output second boost data, when the gamma value of the second input data is 0.

In an exemplary embodiment, the second boosting circuit includes a second address generator configured to receive the input image data and output a second address signal according to the gamma value of the first input data and the gamma value of the third input data when the gamma value of the second input data is 0, and a second register having entries configured to store gamma values and corresponding addresses and output one of the gamma values according to the second address signal, as the second boost data.

In an exemplary embodiment, the input image data includes first through third input data, and the third data processing part includes a third boosting circuit increasing a gamma value of the third input data according to a gamma value of the first input data and a gamma value of the second input data to output third boost data, when the gamma value of the third input data is 0.

In an exemplary embodiment, the third boosting part includes a third address generator configured to receive the input image data and output a third address signal according to the gamma value of the first input data and the gamma value of the second input data when the gamma value of the third input data is 0, and a third register having entries configured to store gamma values and corresponding addresses and output one of the gamma values according to the third address signal, as the third boost data.

In an exemplary embodiment, the input image data includes first through third input data, and the first data processing circuit includes first boosting circuits having first registers according to areas of the display panel and increasing a gamma value of the first input data according to gamma values stored in the first registers, respectively, to output first boosting data.

In an exemplary embodiment, the input image data includes first through third input data, and the second data processing circuit includes second boosting circuits having second registers according to areas of the display panel and increasing a gamma value of the second input data according to gamma values stored in the second registers, respectively, to output second boosting data.

In an exemplary embodiment, the input image data includes first through third input data, and the second data processing circuit includes second boosting circuits having second registers according to areas of the display panel and increasing a gamma value of the second input data according to gamma values stored in the second registers, respectively, to output second boosting data.

In an exemplary embodiment, the data processing circuit further includes a line memory to sequentially store and output input image data corresponding to an (N−1)-th (N is a natural number equal to or greater than 2) gate line and input image data corresponding to an N-th gate line, among the input image data.

According to an exemplary embodiment of the present inventive concept, a method of driving a display panel includes increasing a first gamma value of input image data of which the gamma value is 0, according to a second gamma value of the input data of which the gamma value is not 0, to output image data including first output data, second output data and third output data, output a data signal based on the output image data to a data line of the display panel, and output a gate signal to a gate line of the display panel.

According to an exemplary embodiment of the present inventive concept, a display apparatus includes a display panel and a display panel driving apparatus. The display panel includes a data line and a gate line. The display panel driving apparatus includes a gate driver configured to output a gate signal to the gate line, a data processing circuit configured to increase a first gamma value of first input data, according to a second gamma value of second input data and a third gamma value of third input data, when the first gamma value is 0, to output image data including first output data, second output data and third output data, a data driver configured to output a data signal based on the output image data output from the data processing circuit to the data line. In this embodiment, the input image data includes the first through third input data that is input to the data processing circuit.

According to an exemplary embodiment of the present inventive concept, a driving apparatus for a display panel is provided. The driving apparatus includes a timing controller configured to receive input image data having first input data, second input data, and third input data, and provide output image data to a data driver providing data signals to the display panel. The timing controller increases a first gamma value of the first input data to an increased gamma value and provides the output image data based on the increased gamma value, when the first gamma value is 0 and at least one of a second gamma value of the second input data and a third gamma value of the third input data is not 0.

In an exemplary embodiment, the increased gamma value is based on both the second gamma value and the third gamma value when the second gamma value and the third gamma value are both not 0, and otherwise the increased gamma value is only based on one of the second and third gamma values that is not 0. In an exemplary embodiment, the timing controller performs a color correction on the input image data to generate the output image data when none of the gamma values is 0. In an exemplary embodiment, the timing controller provides the output image data based on the first gamma value, when the first gamma value, the second gamma value, and the third gamma value are all 0.

According to at least one embodiment of the inventive concept, when at least one of a gamma value of first input data, a gamma value of second input data and a gamma value of third input data is 0, a data processing circuit increases the gamma value of the input data of which the gamma value is 0, and thus a charge rate at which data is charged in a pixel may be increased. In addition, the data processing circuit gradually increases the gamma value of the input data of which the gamma value is 0, according to a gamma value of the input data of which the gamma value is not 0, and thus a side luminance difference of the display panel may be decreased. Thus, display quality of the display apparatus may be improved.

BRIEF DESCRIPTION OF THE DRAWINGS

The present inventive concept will become more apparent by describing in detail exemplary embodiments thereof with reference to the accompanying drawings, in which.

DETAILED DESCRIPTION OF THE EXEMPLARY EMBODIMENTS

Hereinafter, the present inventive concept will be explained in detail with reference to the accompanying drawings.

Figure 1:
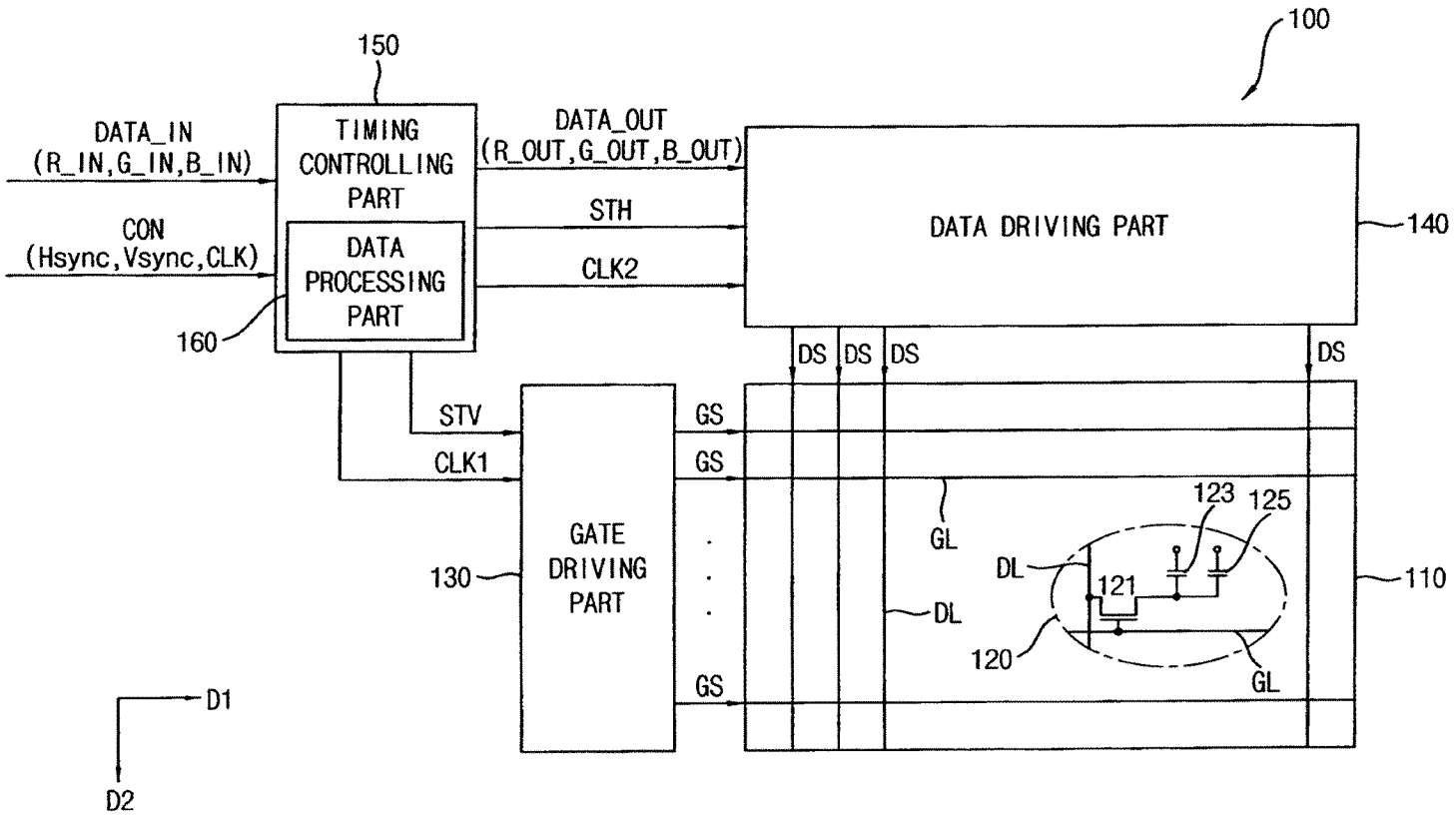
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus 100 according to the present exemplary embodiment includes a display panel 110, a gate driving part 130 (e.g., a gate driver or gate driving circuit), a data driving part 140 (e.g., a data driver or a data driving circuit) and a timing controlling part 150 (e.g., a timing controller or timing control circuit).

The display panel 110 receives data signals DS based on an output image data DATA_OUT provided from the timing controlling part 150 to display an image. The display panel 110 includes gate lines GL, data lines DL and a plurality of pixels 120. In an embodiment, the gate lines GL extend in a first direction D1 and are arranged in a second direction D2 substantially perpendicular to the first direction D1. In an embodiment, the data lines DL extend in the second direction D2 and are arranged in the first direction D1. Each of the pixels 120 includes a thin film transistor 121 electrically connected to the gate line GL and a corresponding one of the data lines DL, a liquid crystal capacitor 123 and a storage capacitor 125 connected to the thin film transistor 121.

The gate driving part 130 generates gate signals GS in response to a vertical start signal STV and a first clock signal CLK1 provided from the timing controlling part 150, and outputs the gate signals GS to the gate lines GL.

The data driving part 140 outputs the data signals DS to the data lines DL in response to a horizontal start signal STH and a second clock signal CLK2 provided from the timing controlling part 150.

The timing controlling part 150 receives the input image data DATA_IN and a control signal CON from an outside source. The control signal CON may include a horizontal synchronous signal Hsync, a vertical synchronous signal Vsync and a clock signal CLK. The timing controlling part 150 generates the horizontal start signal STH using the horizontal synchronous signal Hsync and outputs the horizontal start signal STH to the data driving part 140. In addition, the timing controlling part 150 generates the vertical start signal STV using the vertical synchronous signal Vsync and outputs the vertical start signal STV to the gate driving part 130. In addition, the timing controlling part 150 generates the first clock signal CLK1 and the second clock signal CLK2 using the clock signal CLK, outputs the first clock signal CLK1 to the gate driving part 130, and outputs the second clock signal CLK2 to the data driving part 140.

The timing controlling part 150 includes a data processing part 160 (e.g., a data processing circuit, a central processing unit, a microprocessor, etc.). The data processing part 160 receives the input image data DATA_IN and outputs the output image data DATA_OUT. The input image data DATA_IN may include first input data R_IN, second input data G_IN and third input data B_IN. Here, the first input data R_IN may be red input data, the second input data G_IN may be green input data, and the third input data B_IN may be blue input data. The output image data DATA_OUT may include first output data R_OUT, second output data G_OUT and third output data B_OUT. Here, the first output data R_OUT may be red output data, the second output data G_OUT may be green output data, and the third output data B_OUT may be blue output data. The data processing part 160 can adjust the input image data DATA_IN using associated gamma values to generate the output image data DATA_OUT. For example, the input image data for each pixel may be associated with three gamma values. For example, the red input image data for a pixel may be associated with a red gamma value, the green input image data for the pixel may be associated with a green gamma value, and the blue input image data for the pixel may be associated with a blue gamma value.

When at least one gamma value is 0 and at least one gamma value is not 0 among a gamma value of the first input data R_IN, a gamma value of the second input data G_IN and a gamma value of the third input data B_IN, in an exemplary of the inventive concept, the data processing part 160 increases a gamma value of input data of which the gamma value is 0 according to a gamma value of input data of which the gamma value is not 0 to output the output image data DATA_OUT including the first output data R_OUT, the second output data G_OUT and the third output data B_OUT. Specifically, when at least one gamma value is 0 and at least one gamma value is not 0 among the gamma value of the first input data R_IN, the gamma value of the second input data G_IN and the gamma value of the third input data B_IN, the data processing part 160 increases the gamma value of the input data of which the gamma value is 0 such that the gamma value of the input data of which the gamma value is 0 increases according to an increase of the gamma value of the input data of which the gamma value is not 0 to output the output image data DATA_OUT including the first output data R_OUT, the second output data G_OUT and the third output data B_OUT.

For example, a gamma value of the first input data R_IN in the input image data DATA_IN, a gamma value of the second input data G_IN in the input image data DATA_IN and a gamma value of the third input data B_IN in the input image data DATA_IN may be the same as the following Table 1.

TABLE 1

| R_IN | G_IN | B_IN |
|---|---|---|
| 0 | 0 | 0 |
| 0 | 0 | 1 |
| 0 | 0 | 2 |
| 0 | 0 | 3 |
| . | . | . |
| . | . | . |
| . | . | . |
| 0 | 0 | 31 |

In this case, a gamma value of the first output data R_OUT in the output image data DATA_OUT, a gamma value of the second output data G_OUT in the output image data DATA_OUT and a gamma value of the third output data B_OUT in the output image data DATA_OUT may be the same as following Table 2.

TABLE 2

| R_OUT | G_OUT | B_OUT |
|---|---|---|
| 0 | 0 | 0 |
| 0.025 | 0.025 | 1 |
| 0.05 | 0.05 | 2 |
| 0.075 | 0.075 | 3 |
| . | . | . |
| . | . | . |
| . | . | . |
| 0.7 | 0.7 | 31 |

Referring to Table 1 and Table 2, when the gamma value of the first input data R_IN is 0, the gamma value of the second input data G_IN is 0, and the gamma value of the third input data B_IN is not 0, the data processing part 160 may increase the gamma value of the first input data R_IN and the gamma value of the second input data G_IN according to the gamma value of the third input data B_IN.

Table 1 and Table 2 illustrate an example of a case in which the gamma value of the first input data R_IN is 0, the gamma value of the second input data G_IN is 0 and the gamma value of the third input data B_IN is not 0. However, the present invention is not limited thereto. Specifically, in the same manner as the example of Table 1 and Table 2, in a case in which the gamma value of the first input data R_IN is 0, the gamma value of the third input data B_IN is 0 and the gamma value of the second input data G_IN is not 0, the data processing part 160 may increase the gamma value of the first input data R_IN and the gamma value of the third input data B_IN according to the gamma value of the second input data G_IN. In addition, in the same manner as the example of Table 1 and Table 2, in a case in which the gamma value of the second input data G_IN is 0, the gamma value of the third input data B_IN is 0 and the gamma value of the first input data R_IN is not 0, the data processing part 160 may increase the gamma value of the second input data G_IN and the gamma value of the third input data B_IN according to the gamma value of the first input data R_IN.

In addition, the gamma value of the first input data R_IN in the input image data DATA_IN, the gamma value of the second input data G_IN in the input image data DATA_IN and the gamma value of the third input data B_IN in the input image data DATA_IN may be the same as following Table 3.

TABLE 3

| R_IN | G_IN | B_IN |
|---|---|---|
| 0 | 0 | 0 |
| 0 | 1 | 1 |
| 0 | 2 | 2 |
| 0 | 3 | 3 |
| . | . | . |
| . | . | . |
| . | . | . |
| 0 | 31 | 31 |

In this case, the gamma value of the first output data R_OUT in the output image data DATA_OUT, the gamma value of the second output data G_OUT in the output image data DATA_OUT and the gamma value of the third output data B_OUT in the output image data DATA_OUT may be the same as following Table 4.

TABLE 4

| R_OUT | G_OUT | B_OUT |
|---|---|---|
| 0 | 0 | 0 |
| 0.025 | 1 | 1 |
| 0.05 | 2 | 2 |
| 0.075 | 3 | 3 |
| . | . | . |
| . | . | . |
| . | . | . |
| 0.7 | 31 | 31 |

Referring to Table 3 and Table 4, when the gamma value of the first input data R_IN is 0, the gamma value of the second input data G_IN is not 0, and the gamma value of the third input data B_IN is not 0, in an exemplary embodiment, the data processing part 160 increases the gamma value of the first input data R_IN according to the gamma value of the second input data G_IN and the gamma value of the third input data B_IN.

In an exemplary embodiment, a pre-defined function may be used to generate the new gamma value of the first input data R_IN that takes values of the second input data G_IN and the gamma value of the third input data B_IN as inputs. In an exemplary embodiment, a pre-defined value is used to generate the new gamma value. For example, an average value of the gamma value of the second input data G_IN that is not 0 and the gamma value of the third input data B_IN that is not 0 may be generated and multiplied by a pre-defined value to arrive at the new gamma value. For example, if the pre-defined value is 0.025, and the gamma values of the second input data G_IN and the third input data B_IN are 1, then the gamma value of the first input data R_IN is increased from 0 to 0.025. The pre-defined value being set to 0.025 is an example, and can be changed to various values in other embodiments.

Table 3 and Table 4 illustrate an example of a case in which the gamma value of the first input data R_IN is 0, the gamma value of the second input data G_IN is not 0 and the gamma value of the third input data B_IN is not 0. However, the present inventive concept is not limited thereto. Specifically, in the same manner as the example of Table 3 and Table 4, in a case in which the gamma value of the second input data G_IN is 0, the gamma value of the first input data R_IN is not 0 and the gamma value of the third input data B_IN is not 0, the data processing part 160 may increase the gamma value of the second input data G_IN according to the gamma value of the first input data R_IN and the gamma value of the third input data B_IN. In addition, in the same manner as the example of Table 3 and Table 4, in a case in which the gamma value of the third input data B_IN is 0, the gamma value of the first input data R_IN is not 0 and the gamma value of the second input data G_IN is not 0, the data processing part 160 may increase the gamma value of the third input data B_IN according to the gamma value of the first input data R_IN and the gamma value of the second input data G_IN.

Figure 2:
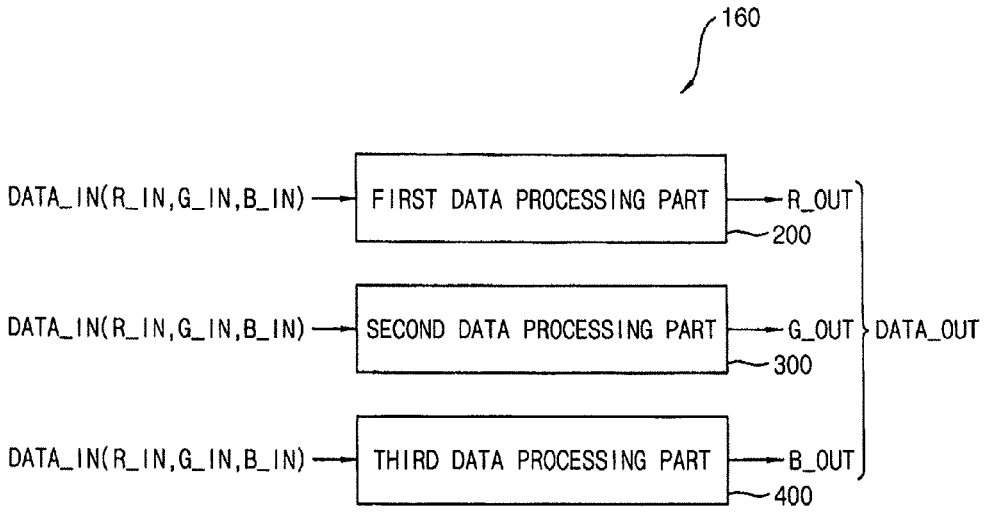
FIG. 2 is a block diagram illustrating a data processing part of FIG. 1 according to an exemplary embodiment of the present inventive concept.

FIG. 2 is a block diagram illustrating the data processing part 160 of FIG. 1 according to an exemplary embodiment of the inventive concept.

Referring to FIGS. 1 and 2, the data processing part 160 includes a first data processing part 200 (e.g., a first processor or circuit), a second data processing part 300 (e.g., a second processor or circuit) and a third data processing part 400 (e.g., a third processor or circuit).

The first data processing part 200 receives the input image data DATA_IN and outputs the first output data R_OUT. The second data processing part 300 receives the input image data DATA_IN and outputs the second output data G_OUT. The third data processing part 400 receives the input image data DATA_IN and outputs the third output data B_OUT. For example, the first data processing part 200 extracts the first input data R_IN from the input image data DATA_IN and generates the first output data R_OUT from the extracted data. For example, the second data processing part 300 extracts the second input data G_IN from the input image data DATA_IN and generates the second output data G_OUT from the extracted data. For example, the third data processing part 300 extracts the third input data B_IN from the input image data DATA_IN and generates the third output data B_OUT from the extracted data.

Figure 3:
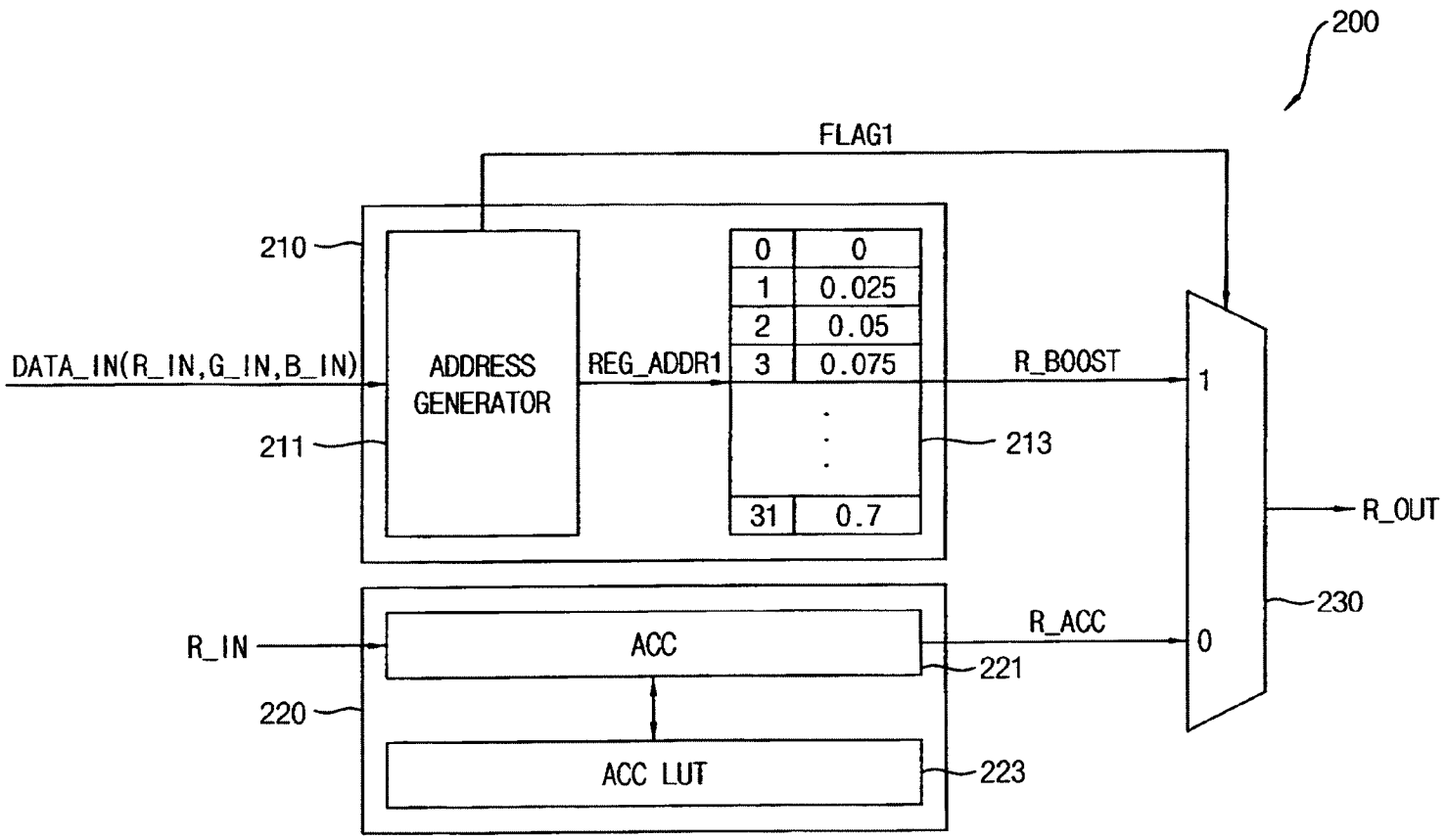
FIG. 3 is a block diagram illustrating a first data processing part of FIG. 2 according to an exemplary embodiment of the present inventive concept.

FIG. 3 is a block diagram illustrating the first data processing part 200 of FIG. 2 according to an exemplary embodiment of the inventive concept.

Referring to FIGS. 1 to 3, the first data processing part 200 includes a first boosting part 210 and a first Accurate Color Capture (ACC) part 220.

The first boosting part 210 receives the input image data DATA_IN. When the gamma value of the first input data R_IN among the first input data R_IN, the second input data G_IN and the third input data B_IN in the input image data DATA_IN is 0, the first boosting part 210 increases the gamma value of the first input data R_IN according to the gamma value of the second input data G_IN and the gamma value of the third input data B_IN and outputs first boost data R_BOOST. In an embodiment, the first boost data R_BOOST is generated from the increased gamma value and the first input data R_IN.

The first boosting part 210 includes a first address generator 211 and a first register 213.

The first address generator 211 receives the input image data DATA_IN. When the gamma value of the first input data R_IN is 0, the first address generator 211 outputs a first address signal REG_ADDR1 according to the gamma value of the second input data G_IN and the gamma value of the third input data B_IN. In addition, the first address generator 211 outputs a first selection signal FLAG1 indicating whether the gamma value of the first input data R_IN is 0. For example, when the gamma value of the first input data R_IN is 0, the first selection signal FLAG1 may have a high level, and when the gamma value of the first input data R_IN is not 0, the first selection signal FLAG1 may have a low level.

The first register 213 includes several entries to store gamma values. Each entry includes an address and a corresponding one of the gamma values. For example, a gamma value of 0 may be stored in an address of 0, a gamma value of 0.025 may be stored in an address of 1, a gamma value of 0.05 may be stored in an address of 2, a gamma value of 0.075 may be stored in an address of 3, and a gamma value of 0.7 may be stored in an address of 31. The first register 213 may output one of the gamma values as the first boost data R_BOOST, according to the first address signal REG_ADDR1. For example, the first address signal REG_ADDR1 may include an address used as an index into the first register 213 to retrieve the corresponding gamma value.

The first ACC part 220 includes a first ACC performer 221 and a first ACC look-up table 223.

When the gamma value of the first input data R_IN is not 0, the first ACC performer 221 performs an ACC on the first input data R_IN according to ACC data stored in the first ACC look-up table 223 and outputs first ACC data R_ACC. The first ACC look-up table 223 stores the ACC data. In an embodiment, the first ACC performer 221 performs the ACC by performing a color correction operation on the first input data R_IN to generate the first ACC data R_ACC.

The first selector 230 receives the first selection signal FLAG1, and selectively outputs the first boost data R_BOOST output from the first boosting part 210 and the first ACC data R_ACC output from the first ACC part 220, according to the first selection signal FLAG1. Specifically, when the first selection signal FLAG1 indicates that the gamma value of the first input data R_IN is 0, the first selector 230 outputs the first boosting data R_BOOST output from the first boosting part 210 as the first output data R_OUT. When the first selection signal FLAG1 indicates that the gamma value of the first input data R_IN is not 0, the first selector 230 outputs the first ACC data R_ACC output from the first ACC part 220 as the first output data R_OUT. In an exemplary embodiment, the first selector 230 is implemented by a multiplexer.

Figure 4:
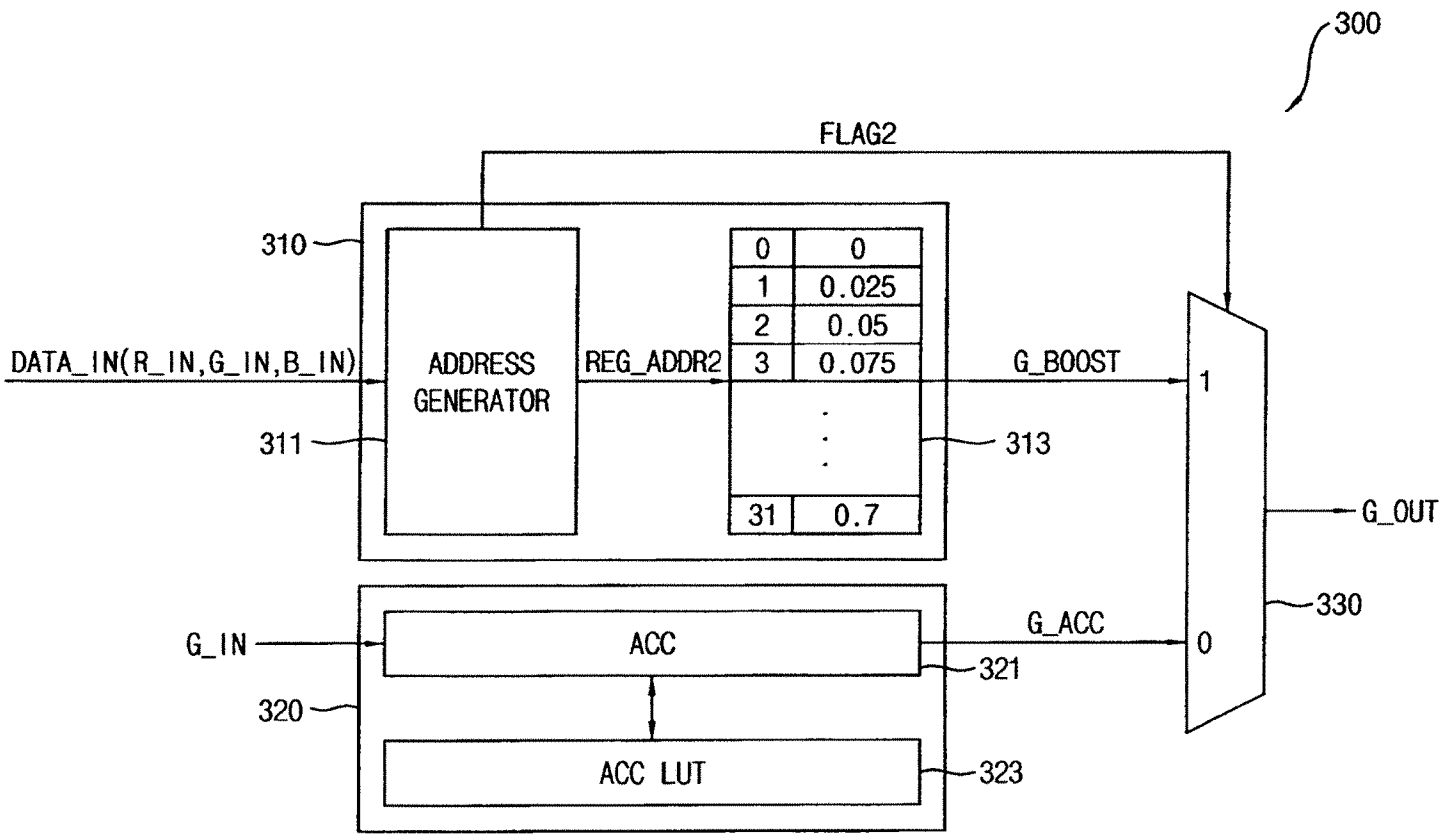
FIG. 4 is a block diagram illustrating a second data processing part of FIG. 2 according to an exemplary embodiment of the present inventive concept.

FIG. 4 is a block diagram illustrating the second data processing part 300 of FIG. 2 according to an exemplary embodiment of the inventive concept.

Referring to FIGS. 1, 2 and 4, the second data processing part 300 includes a second boosting part 310 and a second ACC part 320.

The second boosting part 310 receives the input image data DATA_IN. When the gamma value of the second input data G_IN among the first input data R_IN, the second input data G_IN and the third input data B_IN in the input image data DATA_IN is 0, the second boosting part 310 increases the gamma value of the second input data G_IN according to the gamma value of the first input data R_IN and the gamma value of the third input data B_IN and outputs second boost data G_BOOST. In an embodiment, the second boost data R_BOOST is generated from the increased gamma value and the second input data G_IN.

The second boosting part 310 includes a second address generator 311 and a second register 313.

The second address generator 311 receives the input image data DATA_IN. When the gamma value of the second input data G_IN is 0, the second address generator 311 outputs a second address signal REG_ADDR2 according to the gamma value of the first input data R_IN and the gamma value of the third input data B_IN. In addition, the second address generator 311 outputs a second selection signal FLAG2 indicating whether the gamma value of the second input data G_IN is 0. For example, when the gamma value of the second input data G_IN is 0, the second selection signal FLAG2 may have a high level, and when the gamma value of the second input data G_IN is not 0, the second selection signal FLAG2 may have a low level.

The second register 313 includes several entries to store gamma values. Each entry includes an address and a corresponding one of the gamma values. For example, a gamma value of 0 may be stored in an address of 0, a gamma value of 0.025 may be stored in an address of 1, a gamma value of 0.05 may be stored in an address of 2, a gamma value of 0.075 may be stored in an address of 3, and a gamma value of 0.7 may be stored in an address of 31. The second register 313 may output one of the gamma values as the second boost data G_BOOST, according to the second address signal REG_ADDR2. For example, the second address signal REG_ADDR2 may include an address used as an index into the second register 313 to retrieve the corresponding gamma value.

The second ACC part 320 may include a second ACC performer 321 and a second ACC look-up table 323.

When the gamma value of the second input data G_IN is not 0, the second ACC performer 321 performs an ACC on the second input data G_IN according to ACC data stored in the second ACC look-up table 323 and outputs second ACC data G_ACC. In an embodiment, the second ACC performer 321 performs the ACC by performing a color correction operation on the second input data G_IN to generate the second ACC data G_ACC. The second ACC look-up table 323 stores the ACC data.

The second selector 330 receives the second selection signal FLAG2, and selectively outputs the second boost data G_BOOST output from the second boosting part 310 and the second ACC data G_ACC output from the second ACC part 320, according to the second selection signal FLAG2. Specifically, when the second selection signal FLAG2 indicates that the gamma value of the second input data G_IN is 0, the second selector 330 outputs the second boosting data G_BOOST output from the second boosting part 310 as the second output data G_OUT. When the second selection signal FLAG2 indicates that the gamma value of the second input data G_IN is not 0, the second selector 330 outputs the second ACC data G_ACC output from the second ACC part 320 as the second output data G_OUT. In an embodiment, the second selector 330 is implemented as a multiplexer.

Figure 5:
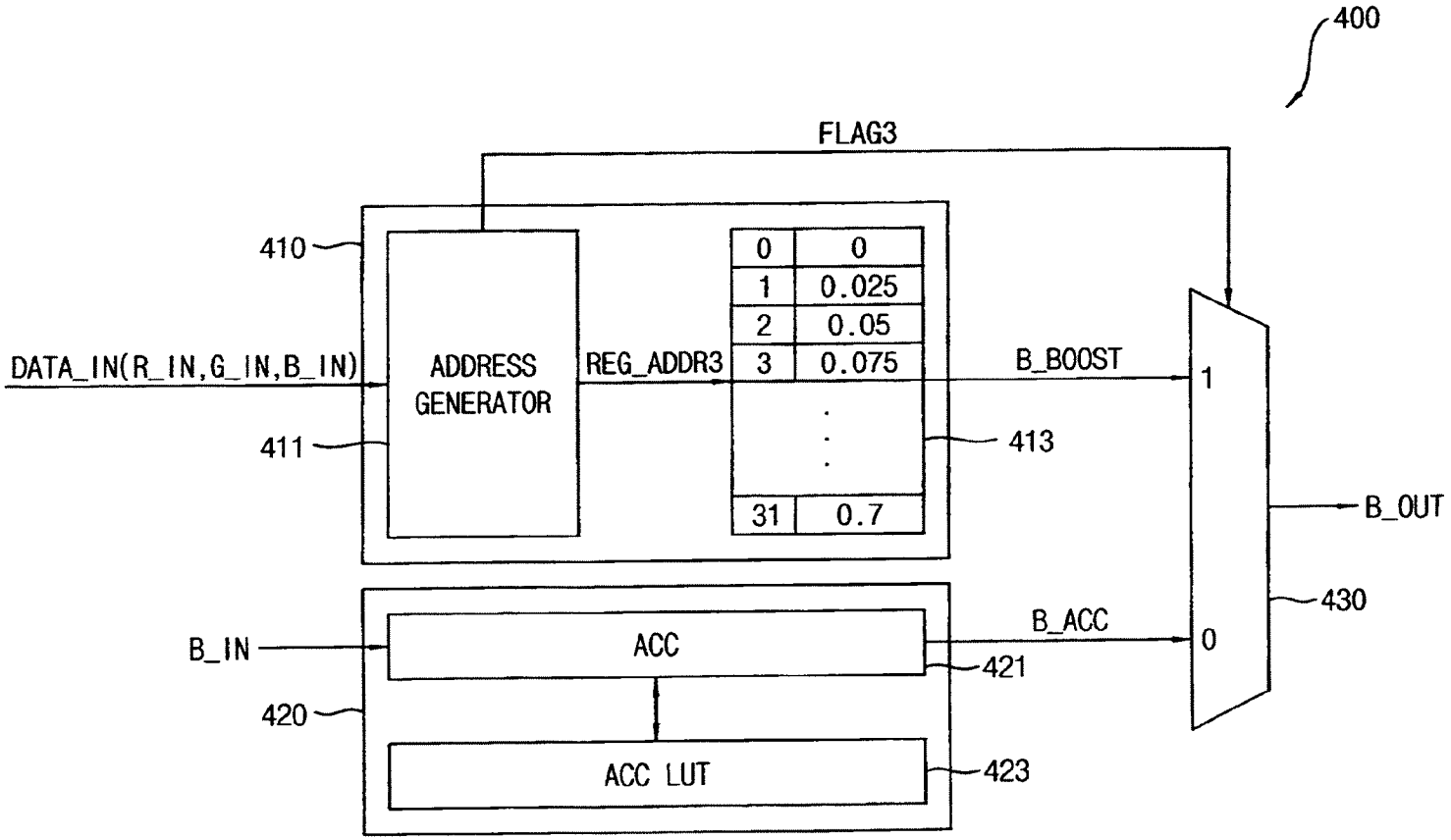
FIG. 5 is a block diagram illustrating a third data processing part of FIG. 2 according to an exemplary embodiment of the present inventive concept.

FIG. 5 is a block diagram illustrating the third data processing part 400 of FIG. 2 according to an exemplary embodiment of the inventive concept.

Referring to FIGS. 1, 2 and 5, the third data processing part 400 includes a third boosting part 410 and a third ACC part 420.

The third boosting part 410 receives the input image data DATA_IN. When the gamma value of the third input data B_IN among the first input data R_IN, the second input data G_IN and the third input data B_IN in the input image data DATA_IN is 0, the third boosting part 410 increases the gamma value of the third input data B_IN according to the gamma value of the first input data R_IN and the gamma value of the second input data G_IN and outputs third boost data B_BOOST. In an embodiment, the third boost data B_BOOST is generated from the increased gamma value and the third input data B_IN.

The third boosting part 410 includes a third address generator 411 and a third register 413.

The third address generator 411 receives the input image data DATA_IN. When the gamma value of the third input data B_IN is 0, the third address generator 411 outputs a third address signal REG_ADDR3 according to the gamma value of the first input data R_IN and the gamma value of the second input data G_IN. In addition, the third address generator 411 outputs a third selection signal FLAG3 indicating whether the gamma value of the third input data B_IN is 0. For example, when the gamma value of the third input data B_IN is 0, the third selection signal FLAG3 may have a high level, and when the gamma value of the third input data B_IN is not 0, the third selection signal FLAG3 may have a low level.

The third register 413 includes several entries to store gamma values. Each entry includes an address and a corresponding one of the gamma values. For example, a gamma value of 0 may be stored in an address of 0, a gamma value of 0.025 may be stored in an address of 1, a gamma value of 0.05 may be stored in an address of 2, a gamma value of 0.075 may be stored in an address of 3, and a gamma value of 0.7 may be stored in an address of 31. The third register 413 may output one of the gamma values as the third boost data B_BOOST, according to the third address signal REG_ADDR3. For example, the third address signal REG_ADDR2 may include an address used as an index into the third register 413 to retrieve the corresponding gamma value.

The third ACC part 420 includes a third ACC performer 421 and a third ACC look-up table 423.

When the gamma value of the third input data B_IN is not 0, the third ACC performer 421 performs an ACC on the third input data B_IN according to ACC data stored in the third ACC look-up table 423 and outputs third ACC data B_ACC. In an embodiment, the third ACC performer 421 performs a color correction on the third input data B_IN. The third ACC look-up table 423 stores the ACC data.

The third selector 430 receives the third selection signal FLAG3, and selectively outputs the third boost data B_BOOST output from the third boosting part 410 and the third ACC data B_ACC output from the third ACC part 420, according to the third selection signal FLAG3. Specifically, when the third selection signal FLAG3 indicates that the gamma value of the third input data B_IN is 0, the third selector 430 outputs the third boosting data B_BOOST output from the third boosting part 410 as the third output data B_OUT. When the third selection signal FLAG3 indicates that the gamma value of the third input data B_IN is not 0, the third selector 330 outputs the third ACC data B_ACC output from the third ACC part 420 as the third output data B_OUT.

In the present exemplary embodiment, the first register 213, the second register 313 and the third register 413 may be formed of one of the first register 213, the second register 313 and the third register 413, and may be shared by the first boosting part 210, the second boosting part 310 and the third boosting part 410. In an exemplary embodiment, a single register is used to store the data stored by the first register 213, the second register 313, and the third register 413, and the single register is shared by the first boosting part 210, the second boosting part 310 and the third boosting part 410.

Figure 6:
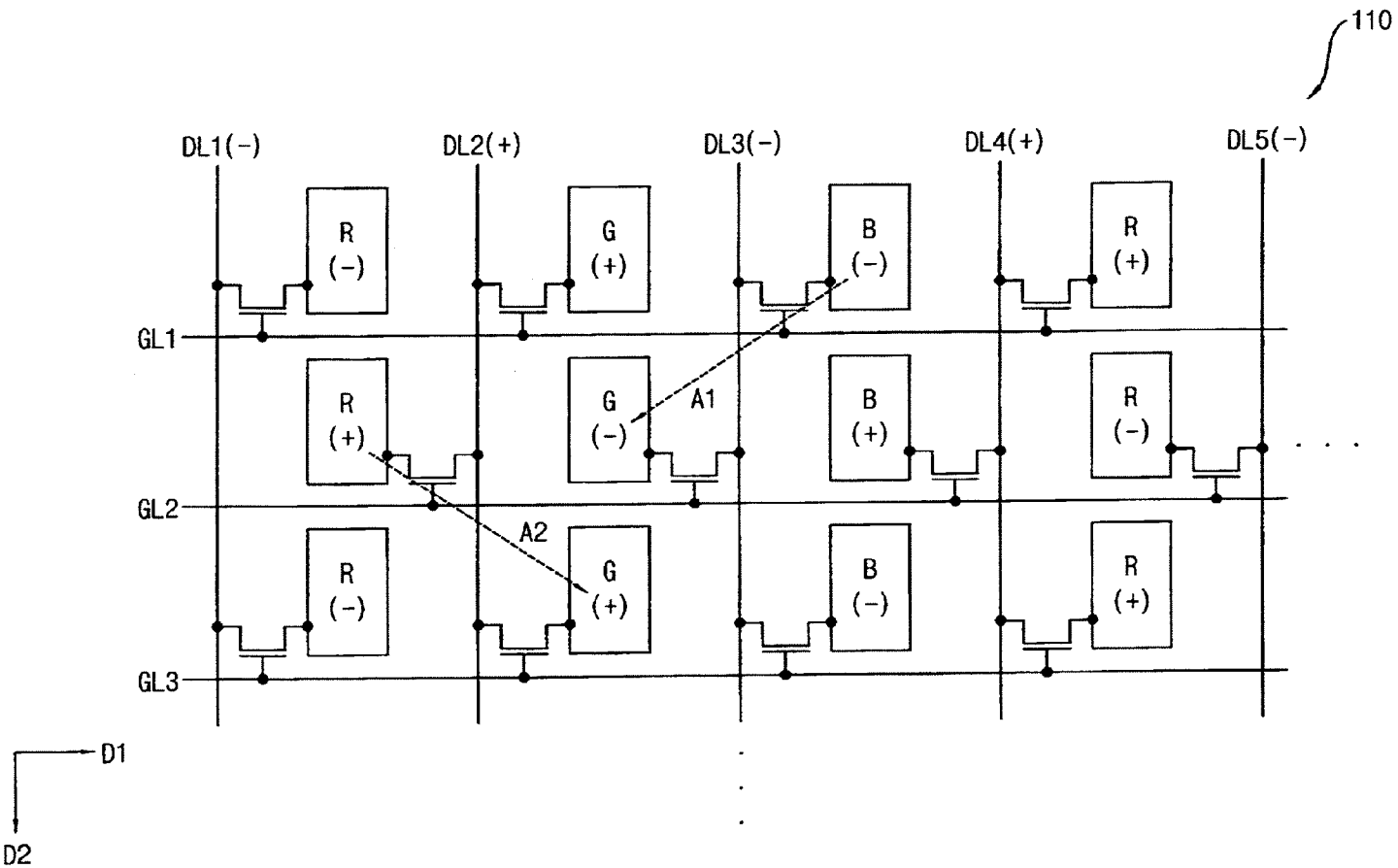
FIG. 6 is a plan view illustrating a display panel of FIG. 1.

FIG. 6 is a plan view illustrating the display panel 110 of FIG. 1.

Referring to FIGS. 1 and 6, the gate lines GL include a first gate line GL1, a second gate line GL2 and a third gate line GL3. The data lines DL include a first data line DL1, a second data line DL2, a third data line DL3, a fourth data line DL4 and a fifth data line DL5.

A red pixel, a green pixel and a blue pixel may be sequentially disposed in the first direction D1, which is a row direction. The red pixel, the green pixel and the blue pixel may be sequentially connected to each of the first to third gate lines GL1, GL2 and GL3.

The red pixels, the green pixels and the blue pixels disposed in the second direction D2, which is a column direction, are alternately connected to data lines disposed on both sides of the red pixels, the green pixels and the blue pixels. Specifically, the red pixels disposed in a first column are alternately connected to the first data line DL1 and the second data line DL2. The green pixels disposed in a second column are alternately connected to the second data line DL2 and the third data line DL3. The blue pixels disposed in a third column are alternately connected to the third data line DL3 and the fourth data line DL4. Data signals having different polarities may be applied to first to fifth data lines DL1, DL2, DL3, DL4 and DL5 alternately.

Figure 7:
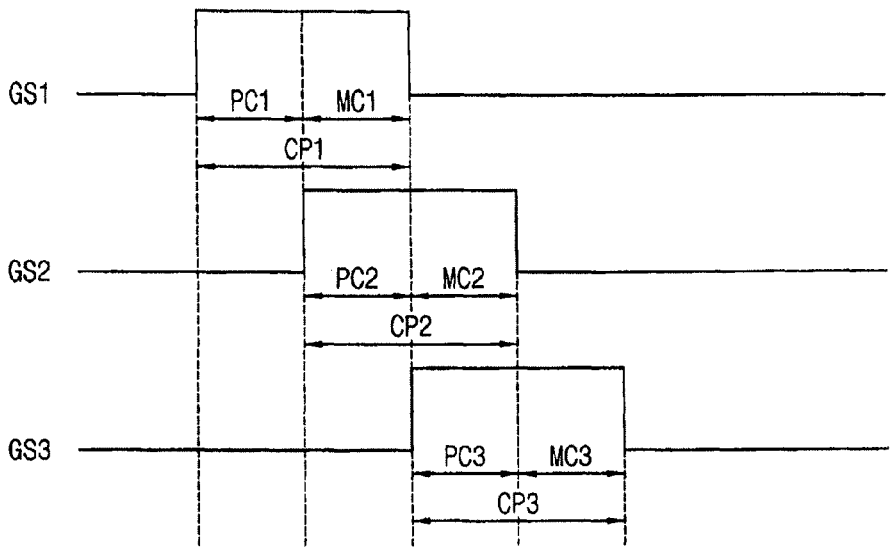
FIG. 7 is a waveforms diagram illustrating a first gate signal, a second gate signal and a third gate signal respectively applied to a first gate line, a second gate line and a third gate line of FIG. 6.

FIG. 7 is a waveforms diagram illustrating a first gate signal GS1, a second gate signal GS2 and a third gate signal GS3 respectively applied to the first gate line GL1, the second gate line GL2 and the third gate line GL3 of FIG. 6.

A first charge period CP1 in which the first gate signal GS1 is activated includes a first pre-charge period PC1 and a first main charge period MC1. A second charge period CP2 in which the second gate signal GS2 is activated includes a second pre-charge period PC2 and a second main charge period MC2. A third charge period CP3 in which the third gate signal GS3 is activated includes a third pre-charge period PC3 and a third main charge period MC3.

Here, the first main charge period MC1 and the second pre-charge period PC2 overlap. Thus, as shown with a reference number 'A1' of FIG. 6, a gamma value of a data signal charged in a pixel connected to the first gate line GL1 during the first main charge MC1 may influence a charge rate at which a data signal is charged in a pixel connected to the second gate line GL2 during the second pre-charge period PC2. In addition, as shown with a reference number 'A2' of FIG. 6, a gamma value of a data signal charged in the pixel connected to the second gate line GL2 during the second main charge period MC2 may influence a charge rate at which a data signal is charged in a pixel connected to the third gate line GL3 during the third pre-charge period PC3.

In the present exemplary embodiment, when at least one of the gamma value of the first input data R_IN, the gamma value of the second input data G_IN and the gamma value of the third input data B_IN is 0, the data processing part 160 increases the gamma value of the input data of which the gamma value is 0, and thus a charge rate at which data is charged in a pixel may be increased. In addition, the data processing part 160 gradually increases the gamma value of the input data of which the gamma value is 0, according to the gamma value of the input data of which the gamma value is not 0, and thus a side luminance difference of the display panel 110 may be decreased.

The gate driving part 130, the data driving part 140 and the timing controlling part 150 may be defined as a display panel driving apparatus driving the display panel 110.

Figure 8:
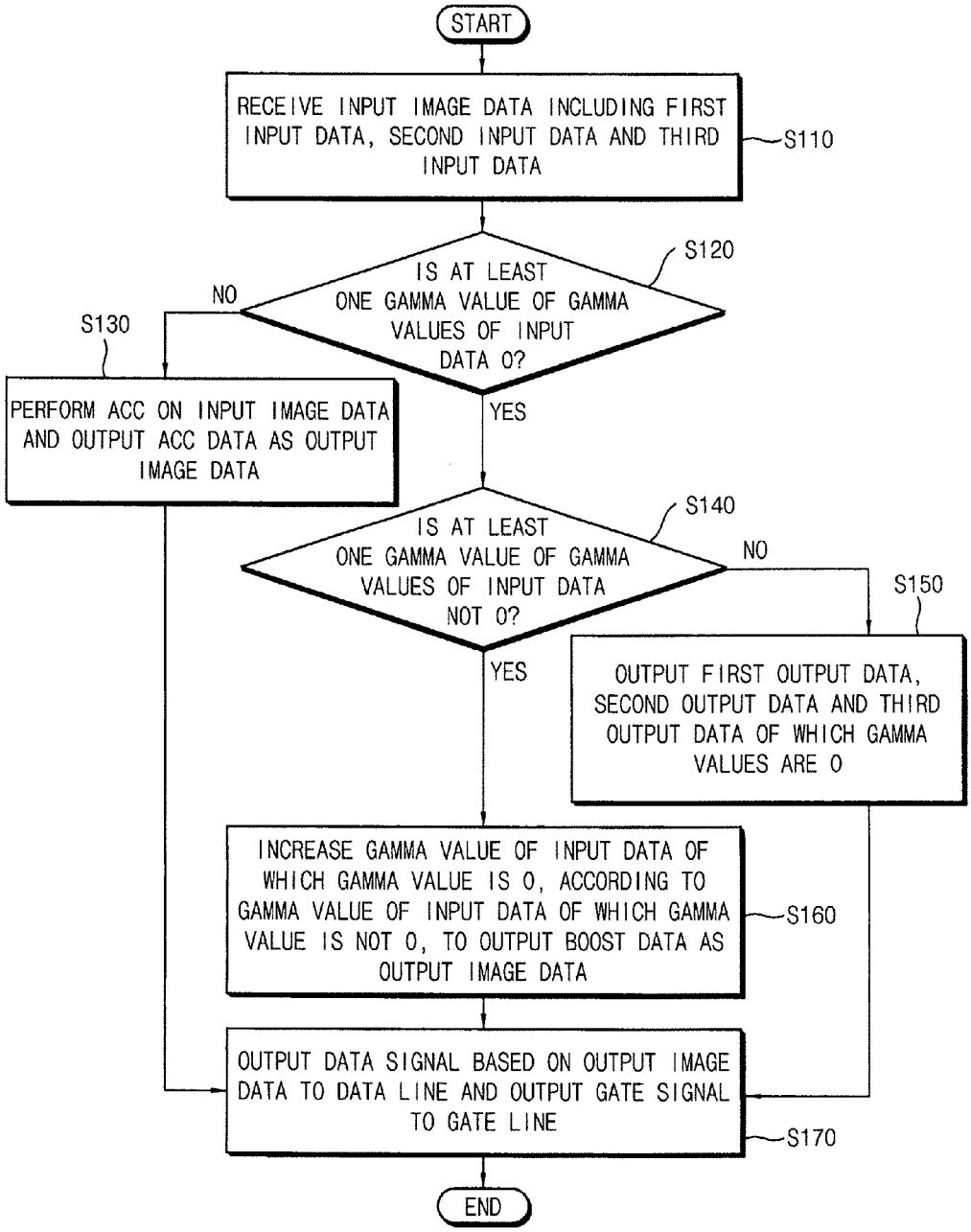
FIG. 8 is a flow chart illustrating a method of driving a display panel performed by a display panel driving apparatus of FIG. 1 according to an exemplary embodiment of the present inventive concept.

FIG. 8 is a flow chart illustrating a method of driving a display panel performed by the display panel driving apparatus of FIG. 1 according to an exemplary embodiment of the inventive concept.

Referring to FIGS. 1 to 8, the method includes receiving input image data DATA_IN including the first input data R_IN, the second input data G_IN and the third input data B_IN is received (step S110). Specifically, the data processing part 160 in the timing controlling part 150 receives the input image data DATA_IN including the first input data R_IN, the second input data G_IN and the third input data B_IN from an outside source.

The method further includes determining whether at least one of the gamma values of the input data is 0 (step S120). Specifically, the data processing part 160 determines whether at least one of the gamma value of the first input data R_IN, the gamma value of the second input data G_IN and the gamma value of the third input data B_IN is 0.

When the gamma values of all input data are not 0, the method performs the ACC (e.g., a color correction) on the input image data DATA_IN to generate ACC data and outputs the ACC data as the output image data DATA_OUT (step S130). Specifically, the data processing part 160 performs the ACC on the first input data R_IN and outputs the first ACC data R_ACC as the first output data R_OUT. In addition, the data processing part 160 performs the ACC on the second input data G_IN and outputs the second ACC data G_ACC as the second output data G_OUT. In addition, the data processing part 160 performs the ACC on the third input data B_IN and outputs the third ACC data B_ACC as the third output data B_OUT.

When at least one gamma value of the gamma values of the input data is 0, the method determines whether at least one gamma value of the gamma values of the input data is not 0 (step S140). Specifically, the data processing part 160 determines whether at least one of the gamma value of the first input data R_IN, the gamma value of the second input data G_IN and the gamma value of the third input data B_IN is not 0.

When the gamma values of all input data are 0, the output image data DATA_OUT including the first output data R_OUT of which the gamma value is 0, the second output data G_OUT of which the gamma value is 0 and the third output data B_OUT of which the gamma value is 0 is output (step S150). Specifically, when the gamma values of all input data are 0, the data processing part 160 outputs the output image data DATA_OUT including the first output data R_OUT of which the gamma value is 0, the second output data G_OUT of which the gamma value is 0 and the third output data B_OUT of which the gamma value is 0.

When at least one of the gamma value of the first input data R_IN, the gamma value of the second input data G_IN and the gamma value of the third input data B_IN is 0, and at least one of the gamma value of the first input data R_IN, the gamma value of the second input data G_IN and the gamma value of the third input data B_IN is not 0, the method increases the gamma value of the input data of which the gamma value is 0 according to the gamma value of the input data of which the gamma value is not 0 and outputs boost data as the output image data DATA_OUT (step S160). Specifically, when at least one of the gamma value of the first input data R_IN, the gamma value of the second input data G_IN and the gamma value of the third input data B_IN is 0, and at least one of the gamma value of the first input data R_IN, the gamma value of the second input data G_IN and the gamma value of the third input data B_IN is not 0, the data processing part 160 outputs the first boost data R_BOOST as the first output data R_OUT, outputs the second boost data G_BOOST as the second output data G_OUT, and outputs the third boost data B_BOOST as the third output data B_OUT.

The method further outputs a data signal DS based on the output image data DATA_OUT to the data line DL, and outputs the gate signal GS to the gate line GL (step S170). Specifically, the data driving part 140 outputs the data signal DS based on the output image data DATA_OUT to the data line DL. The gate driving part 130 outputs the gate signal GS to the gate line GL.

In the present exemplary embodiment, the first input data R_IN is the red input data, the second input data G_IN is the green input data, the third input data B_IN is the blue input data, the first output data R_OUTPUT is the red output data, the second output data G_OUTPUT is the green output data, and the third output data B_OUTPUT is the blue output data, but it is not limited thereto. The first input data R_IN may be first color input data, the second input data G_IN may be second color input data, the third input data B_IN may be third color input data, the first output data R_OUTPUT may be first color output data, the second output data G_OUTPUT may be second color output data, and the third output data B_OUTPUT may be third color output data.

According to the present exemplary embodiment, when at least one of the gamma value of the first input data R_IN, the gamma value of the second input data G_IN and the gamma value of the third input data B_IN is 0, the data processing part 160 increases the gamma value of the input data of which the gamma value is 0, and thus the charge rate at which the data is charged in the pixel may be increased. In addition, the data processing part 160 gradually increases the gamma value of the input data of which the gamma value is 0, according to the gamma value of the input data of which the gamma value is not 0, and thus a side luminance difference of the display panel 110 may be decreased. Thus, display quality of the display apparatus 100 may be improved.

Figure 9:
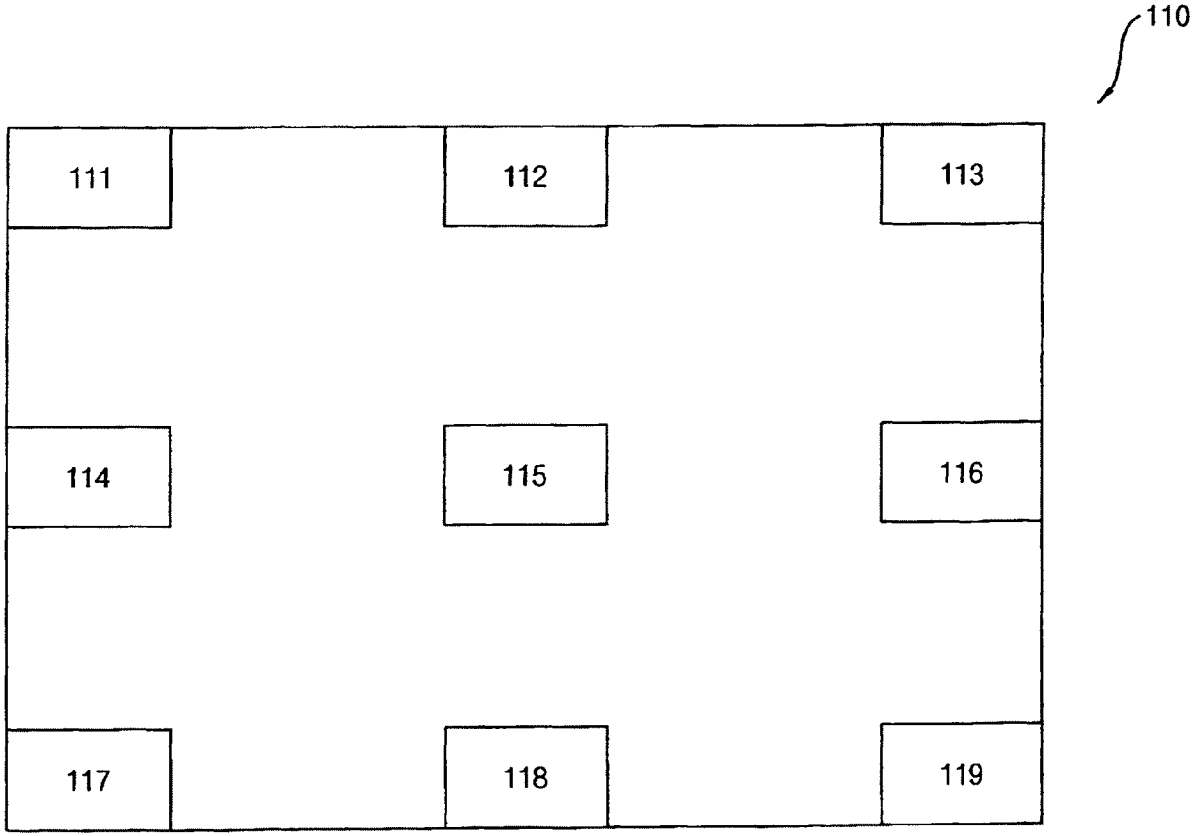
FIG. 9 is a plan view illustrating a display panel according to an exemplary embodiment of the present inventive concept.
Figure 10:
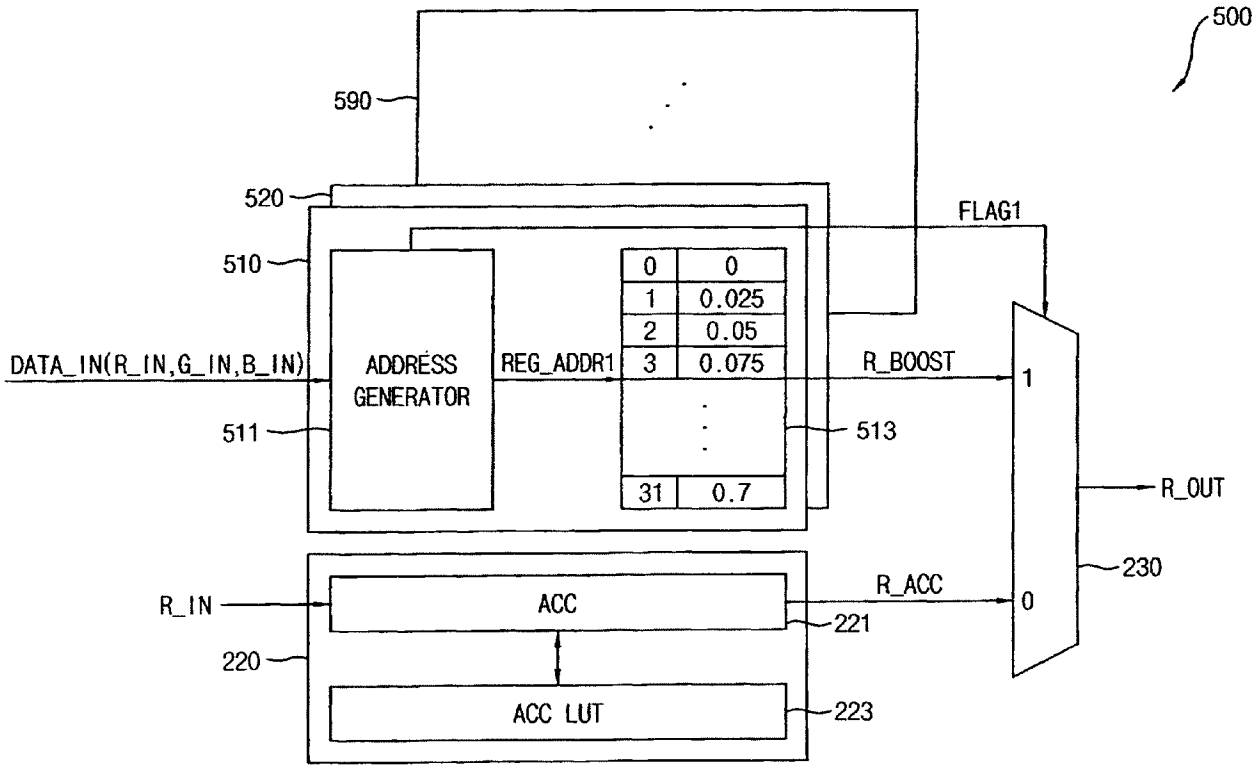
FIG. 10 is a block diagram illustrating a first data processing part according to an exemplary embodiment of the present inventive concept.
Figure 11:
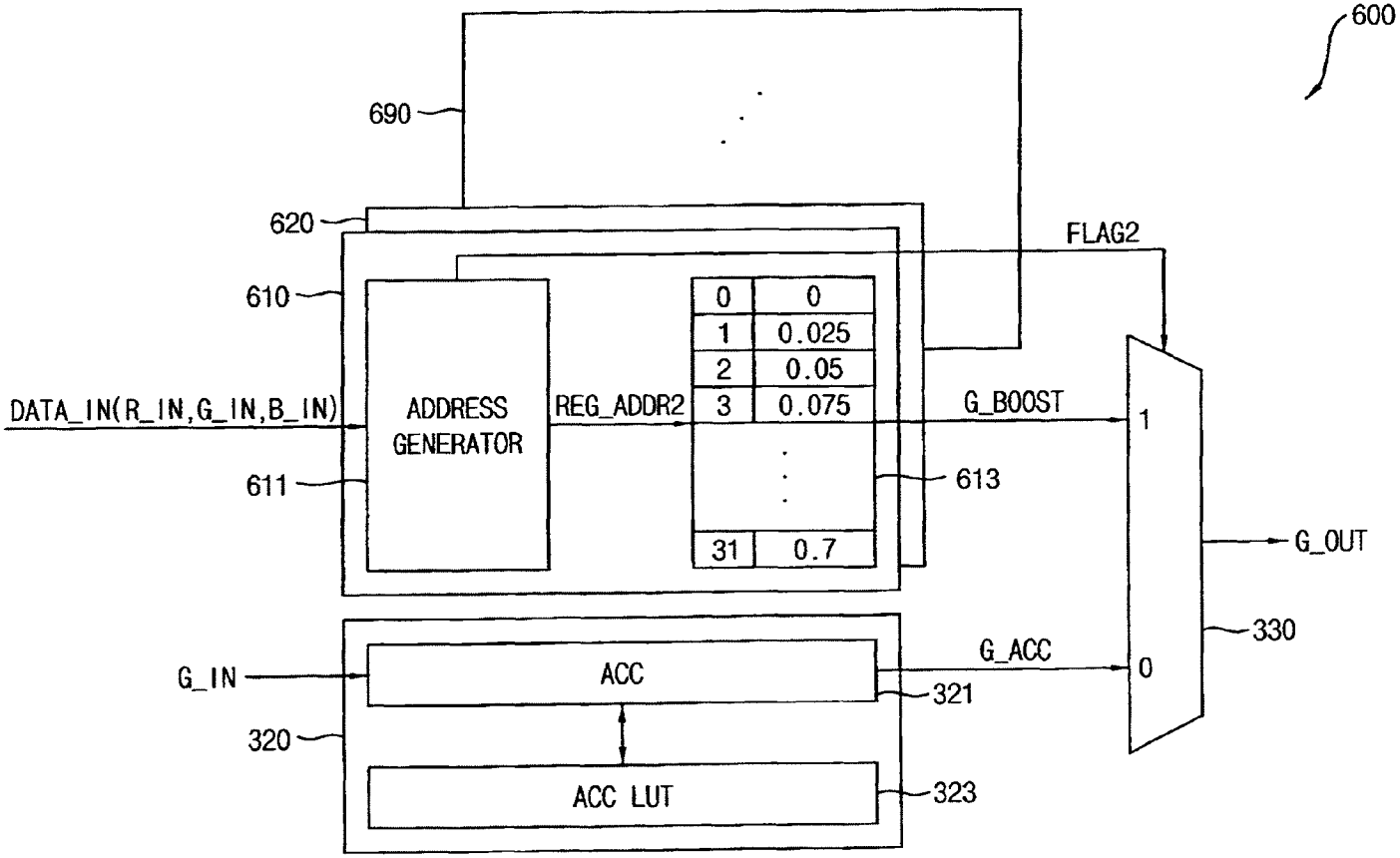
FIG. 11 is a block diagram illustrating a second data processing part according to an exemplary embodiment of the present inventive concept.
Figure 12:
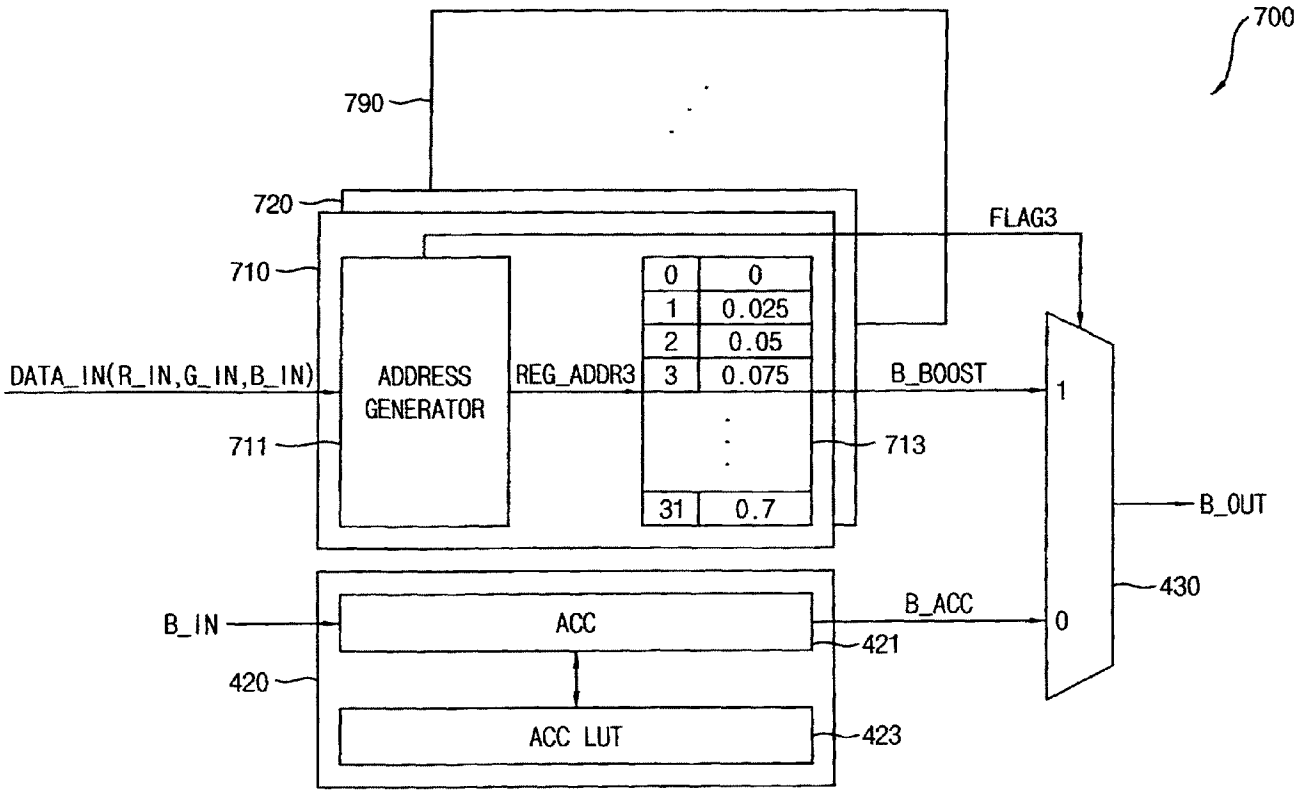
FIG. 12 is a block diagram illustrating a third data processing part according to an exemplary embodiment of the present inventive concept.

FIG. 9 is a plan view illustrating a display panel according to an exemplary embodiment of the present inventive concept. FIG. 10 is a block diagram illustrating a first data processing part according to an exemplary embodiment of the present inventive concept. FIG. 11 is a block diagram illustrating a second data processing part according to an exemplary embodiment of the present inventive concept. FIG. 12 is a block diagram illustrating a third data processing part according to an exemplary embodiment of the present inventive concept.

The display panel 110 according to the present exemplary embodiment illustrated in FIG. 9 may be included in the display apparatus 100 according to the previous exemplary embodiment illustrated in FIG. 1, and may be substantially the same as the display panel 110 according to the previous exemplary embodiment illustrated in FIG. 1. The first processing part 500 according to the present exemplary embodiment illustrated in FIG. 10 may be included in the timing controlling part 150 according to the previous exemplary embodiment illustrated in FIG. 1. The second processing part 600 according to the present exemplary embodiment illustrated in FIG. 11 may be included in the timing controlling part 150 according to the previous exemplary embodiment illustrated in FIG. 1. The third processing part 700 according to the present exemplary embodiment illustrated in FIG. 12 may be included in the timing controlling part 150 according to the previous exemplary embodiment illustrated in FIG. 1. Thus, the same reference numerals will be used to refer to same or like parts as those described in the previous exemplary embodiment and any further repetitive explanation concerning the above elements will be omitted.

Referring to FIG. 9, the display panel 110 includes a first area 111, a second area 112, a third area 113, a fourth area 114, a fifth area 115, a sixth area 116, a seventh area 117, an eighth area 118 and a ninth area 119. The first to ninth areas 111, 112, 113, 114, 115, 116, 117, 118 and 119 may be spaced apart from one another. While nine areas are illustrated in FIG. 9, in alternate embodiments, there may be less than nine or greater than nine areas. While the areas are illustrated in FIG. 9 as being spaced apart, in alternate embodiments at least two of the areas share a same border and are thus immediately adjacent one another. Further, while the areas are illustrated in FIG. 9 as all having the same rectangular shape, in alternate embodiments, the areas can have various shapes (e.g., a square, a circle, rhombus, a diamond, etc.), and the shapes may differ from one another.

Referring to FIG. 10, the first data processing part 500 includes first boosting parts 510, 520, . . . , and 590, a first ACC part 220 and a first selector 230.

Each of the first boosting parts 510, 520, . . . , and 590 of FIG. 10 may be substantially the same as the first boosting part 200 of FIG. 3. But, first registers 513 included in each of the first boosting parts 510, 520, . . . , and 590 respectively store gamma values according to the first to ninth areas 111, 112, 113, 114, 115, 116, 117, 118 and 119.

Each of the first boosting parts 510, 520, . . . , and 590 receives the input image data DATA_IN. When the gamma value of the first input data R_IN among the first input data R_IN, the second input data G_IN and the third input data B_IN in the input image data DATA_IN is 0, each of the first boosting parts 510, 520, . . . , and 590 increases the gamma value of the first input data R_IN according to the gamma value of the second input data G_IN and the gamma value of the third input data B_IN and outputs first boost data R_BOOST. For example, the coordinate of the pixel associated with the first input data R_IN is determined, and if the coordinate is located within the one of the areas, the corresponding boosting unit operates on the first input data R_IN. For example, if boosting unit 520 corresponds to area 112, and the coordinate is located within area 112, then boosting unit 520 operates on the first input data R_IN using its gamma values.

Each of the first boosting parts 510, 520, . . . , and 590 may include a first address generator 511 and the first register 513.

The first address generator 511 receives the input image data DATA_IN. When the gamma value of the first input data R_IN is 0, the first address generator 511 outputs a first address signal REG_ADDR1 according to the gamma value of the second input data G_IN and the gamma value of the third input data B_IN. In addition, the first address generator 511 outputs a first selection signal FLAG1 indicating whether the gamma value of the first input data R_IN is 0. For example, when the gamma value of the first input data R_IN is 0, the first selection signal FLAG1 may have a high level, and when the gamma value of the first input data R_IN is not 0, the first selection signal FLAG1 may have a low level.

The first registers 513 included in each of the first boosting parts 510, 520, . . . , and 590 respectively stores the gamma values according to the first to ninth areas 111, 112, 113, 114, 115, 116, 117, 118 and 119 of the display panel 110. The gamma values stored in the first register 513 included in each of the first boosting parts 510, 520, . . . , and 590 may be different according to the first to ninth areas 111, 112, 113, 114, 115, 116, 117, 118 and 119 of the display panel 110. The first register 513 includes several entries to store the gamma values. Each entry includes one of the gamma values and a corresponding address. The first register 513 outputs one of the gamma values as the first boost data R_BOOST according to the first address signal REG_ADDR1. In an embodiment, the first data processing part 500 processes areas except for the first to ninth areas 111, 112, 113, 114, 115, 116, 117, 118 and 119 in an interpolation method. For example, when the coordinate of the pixel associated with the first input data R_IN is not located within the one of the areas, the first data processing part 500 processes the first input data R_IN in the interpolation method.

The first ACC part 220 is substantially the same as the first ACC part 220 of FIG. 3. Thus, when the gamma value of the first input data R_IN is not 0, the first ACC part 220 performs an ACC on the first input data R_IN according to the ACC data stored in the first ACC look-up table 223 and outputs the first ACC data R_ACC.

The first selector 230 is substantially the same as the first selector 230 of FIG. 3. Thus, the first selector 230 receives the first selection signal FLAG1, and selectively outputs the first boost data R_BOOST output from the first boosting part 510 and the first ACC data R_ACC output from the first ACC part 220, according to the first selection signal FLAG1. Specifically, when the first selection signal FLAG1 indicates that the gamma value of the first input data R_IN is 0, the first selector 230 outputs the first boosting data R_BOOST output from the first boosting part 510 as the first output data R_OUT. When the first selection signal FLAG1 indicates that the gamma value of the first input data R_IN is not 0, the first selector 230 outputs the first ACC data R_ACC output from the first ACC part 220 as the first output data R_OUT.

Referring to FIG. 11, the second data processing part 600 includes second boosting parts 610, 620, . . . , and 690, a second ACC part 320 and a second selector 330.

Each of the second boosting parts 610, 620, . . . , and 690 of FIG. 11 may be substantially the same as the second boosting part 300 of FIG. 4. But, second registers 613 included in each of the second boosting parts 610, 620, . . . , and 690 respectively store gamma values according to the first to ninth areas 111, 112, 113, 114, 115, 116, 117, 118 and 119.

Each of the second boosting parts 610, 620, . . . , and 690 receives the input image data DATA_IN. When the gamma value of the second input data G_IN among the first input data R_IN, the second input data G_IN and the third input data B_IN in the input image data DATA_IN is 0, each of the second boosting parts 610, 620, . . . , and 690 increases the gamma value of the second input data G_IN according to the gamma value of the first input data R_IN and the gamma value of the third input data B_IN and outputs second boost data G_BOOST. For example, the coordinate of the pixel associated with the second input data G_IN is determined, and if the coordinate is located within the one of the areas, the corresponding boosting unit operates on the second input data G_IN. For example, if boosting unit 690 corresponds to area 119, and the coordinate is located within area 119, then boosting unit 690 operates on the second input data G_IN using its gamma values.

Each of the second boosting parts 610, 620, . . . , and 690 includes a second address generator 611 and the second register 613.

The second address generator 611 receives the input image data DATA_IN. When the gamma value of the second input data G_IN is 0, the second address generator 611 outputs a second address signal REG_ADDR2 according to the gamma value of the first input data R_IN and the gamma value of the third input data B_IN. In addition, the second address generator 611 outputs a second selection signal FLAG2 indicating whether the gamma value of the second input data G_IN is 0. For example, when the gamma value of the second input data G_IN is 0, the second selection signal FLAG2 may have a high level, and when the gamma value of the second input data G_IN is not 0, the second selection signal FLAG2 may have a low level.

The second registers 613 included in each of the second boosting parts 610, 620, . . . , and 690 respectively stores the gamma values according to the first to ninth areas 111, 112, 113, 114, 115, 116, 117, 118 and 119 of the display panel 110. The gamma values stored in the second register 613 included in each of the second boosting parts 610, 620, . . . , and 690 may be different according to the first to ninth areas 111, 112, 113, 114, 115, 116, 117, 118 and 119 of the display panel 110. The second register 613 stores the gamma values in each of addresses. The second register 613 may output one of the gamma values as the second boost data G_BOOST according to the second address signal REG_ADDR2. The second data processing part 600 may process areas except for the first to ninth areas 111, 112, 113, 114, 115, 116, 117, 118 and 119 in an interpolation method. For example, when the coordinate of the pixel associated with the second input data G_IN is not located within the one of the areas, the second data processing part 600 processes the second input data G_IN in the interpolation method.

The second ACC part 320 is substantially the same as the second ACC part 320 of FIG. 4. Thus, when the gamma value of the second input data G_IN is not 0, the second ACC part 320 performs an ACC on the second input data G_IN according to the ACC data stored in the second ACC look-up table 323 and outputs the second ACC data G_ACC.

The second selector 330 is substantially the same as the second selector 330 of FIG. 4. Thus, the second selector 330 receives the second selection signal FLAG2, and selectively outputs the second boost data G_BOOST output from the second boosting part 610 and the second ACC data G_ACC output from the second ACC part 320, according to the second selection signal FLAG2. Specifically, when the second selection signal FLAG2 indicates that the gamma value of the second input data G_IN is 0, the second selector 330 outputs the second boosting data G_BOOST output from the second boosting part 610 as the second output data G_OUT. When the second selection signal FLAG2 indicates that the gamma value of the second input data G_IN is not 0, the second selector 330 outputs the second ACC data G_ACC output from the second ACC part 320 as the second output data G_OUT.

Referring to FIG. 12, the third data processing part 700 includes third boosting parts 710, 720, . . . , and 790, a third ACC part 420 and a third selector 430.

Each of the third boosting parts 710, 720, . . . , and 790 of FIG. 12 may be substantially the same as the third boosting part 400 of FIG. 5. But, third registers 713 included in each of the third boosting parts 710, 720, . . . , and 790 respectively store gamma values according to the first to ninth areas 111, 112, 113, 114, 115, 116, 117, 118 and 119.

Each of the third boosting parts 710, 720, . . . , and 790 receives the input image data DATA_IN. When the gamma value of the third input data B_IN among the first input data R_IN, the second input data G_IN and the third input data B_IN in the input image data DATA_IN is 0, each of the third boosting parts 710, 720, . . . , and 790 increases the gamma value of the third input data B_IN according to the gamma value of the first input data R_IN and the gamma value of the second input data G_IN and outputs third boost data B_BOOST. For example, the coordinate of the pixel associated with the third input data B_IN is determined, and if the coordinate is located within the one of the areas, the corresponding boosting unit operates on the third input data B_IN. For example, if boosting unit 710 corresponds to area 111, and the coordinate is located within area 111, then boosting unit 710 operates on the third input data B_IN using its gamma values.

Each of the third boosting parts 710, 720, . . . , and 790 includes a third address generator 711 and the third register 713.

The third address generator 711 receives the input image data DATA_IN. When the gamma value of the third input data B_IN is 0, the third address generator 711 outputs a third address signal REG_ADDR3 according to the gamma value of the first input data R_IN and the gamma value of the second input data G_IN. In addition, the third address generator 711 outputs a third selection signal FLAG3 indicating whether the gamma value of the third input data B_IN is 0. For example, when the gamma value of the third input data B_IN is 0, the third selection signal FLAG3 may have a high level, and when the gamma value of the third input data B_IN is not 0, the third selection signal FLAG3 may have a low level.

The third registers 713 included in each of the third boosting parts 710, 720, . . . , and 790 respectively stores the gamma values according to the first to ninth areas 111, 112, 113, 114, 115, 116, 117, 118 and 119 of the display panel 110. The gamma values stored in the third register 713 included in each of the third boosting parts 710, 720, . . . , and 790 may be different according to the first to ninth areas 111, 112, 113, 114, 115, 116, 117, 118 and 119 of the display panel 110. The third register 713 stores the gamma values in each of addresses. The third register 713 outputs one of the gamma values as the third boost data B_BOOST according to the third address signal REG_ADDR3. The third data processing part 700 may process areas except for the first to ninth areas 111, 112, 113, 114, 115, 116, 117, 118 and 119 in an interpolation method. For example, when the coordinate of the pixel associated with the third input data B_IN is not located within the one of the areas, the third data processing part 700 processes the third input data B_IN in the interpolation method.

The third ACC part 420 is substantially the same as the third ACC part 420 of FIG. 5. Thus, when the gamma value of the third input data B_IN is not 0, the third ACC part 420 performs an ACC on the third input data B_IN according to the ACC data stored in the third ACC look-up table 423 and outputs the third ACC data B_ACC.

The third selector 430 is substantially the same as the third selector 430 of FIG. 5. Thus, the third selector 430 receives the third selection signal FLAG3, and selectively outputs the third boost data B_BOOST output from the third boosting part 710 and the third ACC data B_ACC output from the third ACC part 420, according to the third selection signal FLAG2. Specifically, when the third selection signal FLAG3 indicates that the gamma value of the third input data B_IN is 0, the third selector 430 outputs the third boosting data B_BOOST output from the third boosting part 710 as the third output data B_OUT. When the third selection signal FLAG3 indicates that the gamma value of the third input data B_IN is not 0, the third selector 430 outputs the third ACC data B_ACC output from the third ACC part 420 as the third output data B_OUT.

According to the present exemplary embodiment, when at least one of the gamma value of the first input data R_IN, the gamma value of the second input data G_IN and the gamma value of the third input data B_IN is 0, the first data processing part 500, the second data processing part 600 and the third data processing part 700 increase the gamma value of the input data of which the gamma value is 0, and thus a charge rate at which data is charged in a pixel may be increased. In addition, the first data processing part 500, the second data processing part 600 and the third data processing part 700 gradually increases the gamma value of the input data of which the gamma value is 0, according to the gamma value of the input data of which the gamma value is not 0, and thus a side luminance difference of the display panel 110 may be decreased. Thus, display quality of the display apparatus 100 may be improved.

Figure 13:
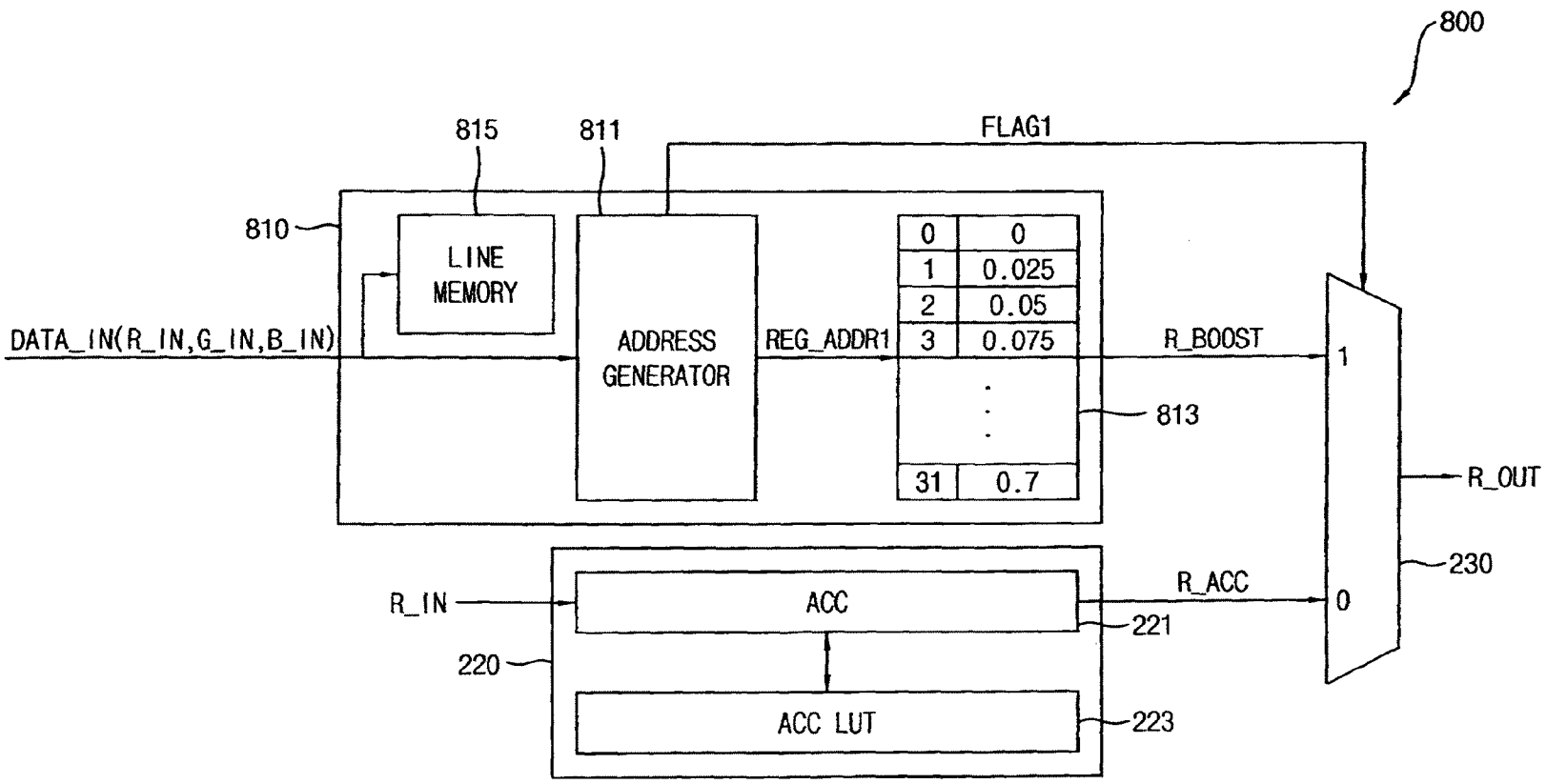
FIG. 13 is a block diagram illustrating a first data processing part according to an exemplary embodiment of the present inventive concept.
Figure 14:
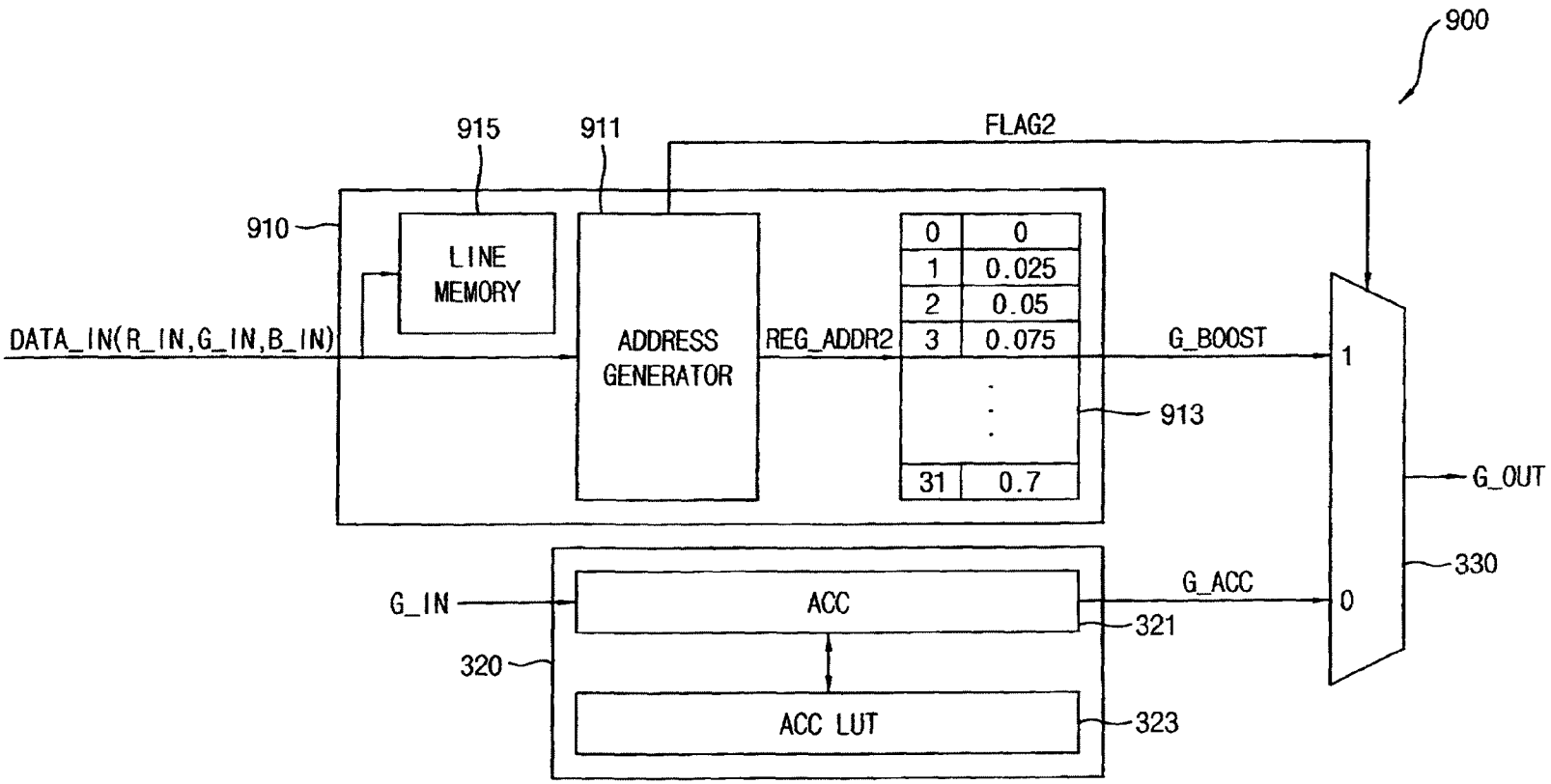
FIG. 14 is a block diagram illustrating a second data processing part according to an exemplary embodiment of the present inventive concept.
Figure 15:
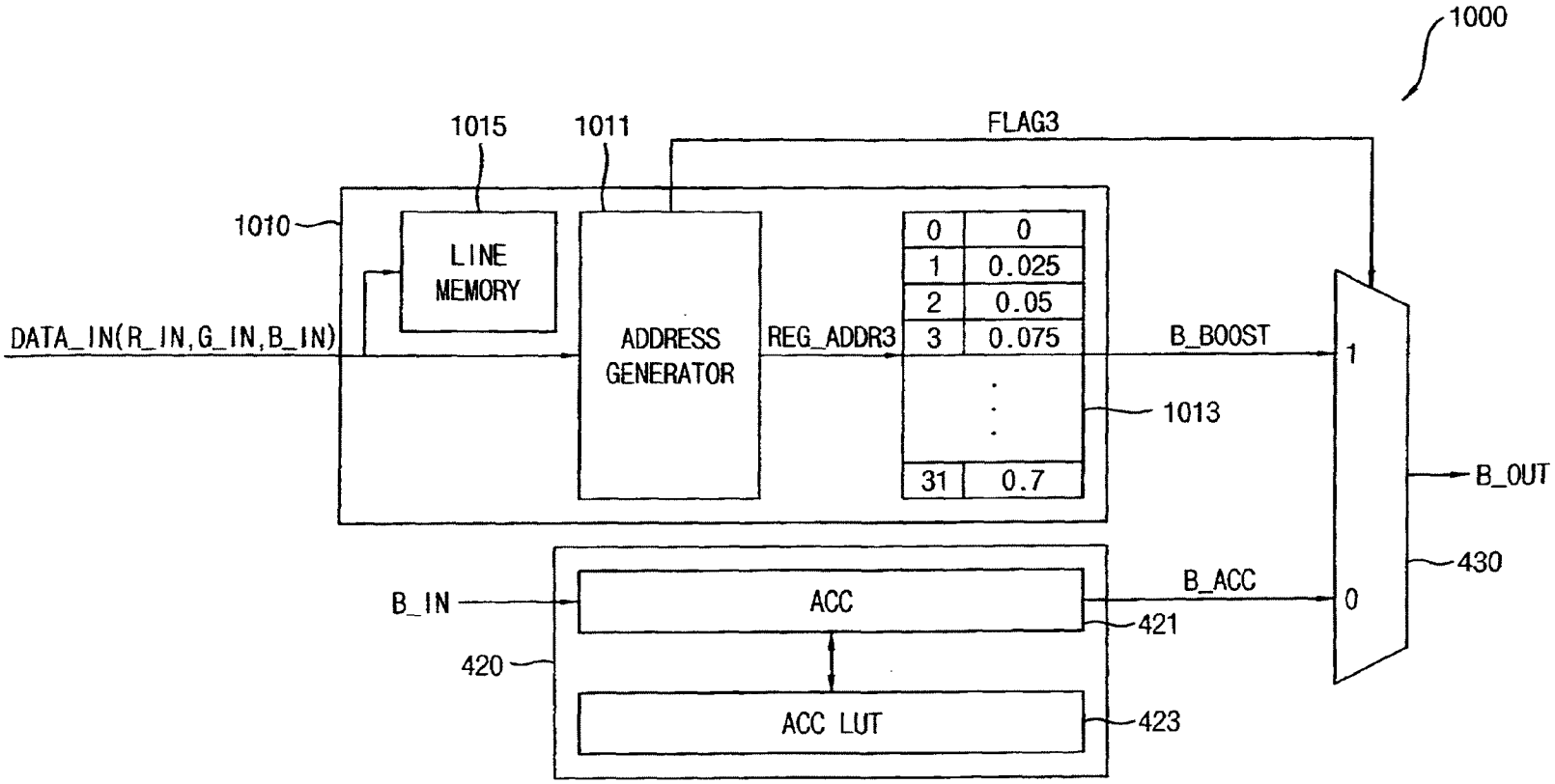
FIG. 15 is a block diagram illustrating a third data processing part according to an exemplary embodiment of the present inventive concept.

FIG. 13 is a block diagram illustrating a first data processing part according to an exemplary embodiment of the present inventive concept. FIG. 14 is a block diagram illustrating a second data processing part according to an exemplary embodiment of the present inventive concept. FIG. 15 is a block diagram illustrating a third data processing part according to an exemplary embodiment of the present inventive concept.

The first processing part 800 according to the present exemplary embodiment illustrated in FIG. 13 may be included in the timing controlling part 150 according to the previous exemplary embodiment illustrated in FIG. 1. The second processing part 900 according to the present exemplary embodiment illustrated in FIG. 14 may be included in the timing controlling part 150 according to the previous exemplary embodiment illustrated in FIG. 1. The third processing part 1000 according to the present exemplary embodiment illustrated in FIG. 15 may be included in the timing controlling part 150 according to the previous exemplary embodiment illustrated in FIG. 1. Thus, the same reference numerals will be used to refer to same or like parts as those described in the previous exemplary embodiment and any further repetitive explanation concerning the above elements will be omitted.

Referring to FIGS. 1 and 13, the first data processing part 800 includes a first boosting part 810, a first ACC part 220 and a first selector 230.

The first boosting part 810 includes a first address generator 811, a first register 813 and a first line memory 815.

The first address generator 811 and the first line memory 815 receive the input image data DATA_IN. In an embodiment, the input image data DATA_IN is image data for displaying a horizontal stripe pattern on the display panel 110. In an embodiment, a horizontal stripe pattern is an image that includes several horizontal lines or rectangles that are spaced a distance apart from one another. For example, the horizontal stripe pattern may include a plurality of first areas that are interleaved with a plurality of second areas, where a color of the first areas differs from a color of the second areas.

Referring to FIGS. 1, 6 and 13, in order to display the horizontal stripe pattern on the display panel 110, the display apparatus 100 receives the first input data R_IN, the second input data G_IN and the third input data B_IN corresponding to a first row of pixels connected to the first gate line GL1. In addition, the display apparatus 100 may receive the first input data R_IN, the second input data G_IN and the third input data B_IN corresponding to a second row of pixels connected to the second gate line GL2. As an example, each gamma value of the first input data R_IN, the second input data G_IN and the third input data B_IN corresponding to the first row of pixels is 0, and each gamma value of the first input data R_IN, the second input data G_IN and the third input data B_IN corresponding to the second row of pixels is not 0.

The first line memory 815 sequentially stores and outputs input image data corresponding to an (N−1)-th gate line and input image data corresponding to an N-th gate line. Here, the (N−1)-th gate line may be the first gate line GL1 and the N-th gate line may be the second gate line GL2.

The first address generator 811 receives the input image data corresponding to the (N−1)-th gate line and the input image data corresponding to the N-th gate line, and outputs a first address signal REG_ADDR1 according to gamma values of the input image data corresponding to the (N−1)-th gate line and the input image data corresponding to the N-th gate line. In addition, the first address generator 811 outputs a first selection signal FLAG1 indicating whether the gamma value of the first input data R_IN is 0. For example, when the gamma value of the first input data R_IN is 0, the first selection signal FLAG1 may have a high level, and when the gamma value of the first input data R_IN is not 0, the first selection signal FLAG1 may have a low level.

The first register 813 includes several entries to store gamma values. Each entry includes one of the gamma values and a corresponding address. For example, a gamma value of 0 may be stored in an address of 0, a gamma value of 0.025 may be stored in an address of 1, a gamma value of 0.05 may be stored in an address of 2, a gamma value of 0.075 may be stored in an address of 3, and a gamma value of 0.7 may be stored in an address of 31. The first register 813 outputs one of the gamma values as the first boost data R_BOOST, according to the first address signal REG_ADDR1.

The first boosting part 810 increases a gamma value of the input image data corresponding to the (N−1)-th gate line in consideration of the input image data corresponding to the (N−1)-th gate line and the input image data corresponding to the N-th gate line. For example, when a gamma value of the first input data R_IN corresponding to the (N−1)-th gate line is 0, a gamma value of the second input data G_IN corresponding to the (N−1)-th gate line is 0, a gamma value of the third input data B_IN corresponding to the (N−1)-th gate line is 0, a gamma value of the first input data R_IN corresponding to the N-th gate line is 31, a gamma value of the second input data G_IN corresponding to the N-th gate line is 31, and a gamma value of the third input data B_IN corresponding to the N-th gate line is 31, the first boosting part 810 increases the gamma value of the first input data R_IN corresponding to the (N−1)-th gate line according to the third input data B_IN corresponding to the N-th gate line and outputs the first boost data R_BOOST.

The first ACC part 220 is substantially the same as the first ACC part 220 of FIG. 3. Thus, when the gamma value of the first input data R_IN is not 0, the first ACC part 220 performs an ACC on the first input data R_IN according to the ACC data stored in the first ACC look-up table 223 and outputs the first ACC data R_ACC.

The first selector 230 is substantially the same as the first selector 230 of FIG. 3. Thus, the first selector 230 receives the first selection signal FLAG1, and selectively outputs the first boost data R_BOOST output from the first boosting part 810 and the first ACC data R_ACC output from the first ACC part 220, according to the first selection signal FLAG1. Specifically, when the first selection signal FLAG1 indicates that the gamma value of the first input data R_IN is 0, the first selector 230 outputs the first boosting data R_BOOST output from the first boosting part 810 as the first output data R_OUT. When the first selection signal FLAG1 indicates that the gamma value of the first input data R_IN is not 0, the first selector 230 outputs the first ACC data R_ACC output from the first ACC part 220 as the first output data R_OUT.

Referring to FIGS. 1 and 14, the second data processing part 900 includes a second boosting part 910, a second ACC part 320 and a second selector 330.

The second boosting part 910 includes a second address generator 911, a second register 913 and a second line memory 915.

The second address generator 911 and the second line memory 915 receive the input image data DATA_IN. The input image data DATA_IN may be image data for displaying a horizontal stripe pattern on the display panel 110.

The second line memory 915 may sequentially store and output the input image data corresponding to the (N−1)-th gate line and the input image data corresponding to the N-th gate line. Here, the (N−1)-th gate line may be the first gate line GL1 of FIG. 6 and the N-th gate line may be the second gate line GL2 of FIG. 6.

The second address generator 911 receives the input image data corresponding to the (N−1)-th gate line and the input image data corresponding to the N-th gate line, and outputs a second address signal REG_ADDR2 according to the gamma values of the input image data corresponding to the (N−1)-th gate line and the input image data corresponding to the N-th gate line. In addition, the second address generator 911 outputs a second selection signal FLAG2 indicating whether the gamma value of the second input data G_IN is 0. For example, when the gamma value of the second input data G_IN is 0, the second selection signal FLAG2 may have a high level, and when the gamma value of the second input data G_IN is not 0, the second selection signal FLAG2 may have a low level.

The second register 913 includes entries to store gamma values. Each entry includes one of the gamma values and a corresponding address. For example, a gamma value of 0 may be stored in an address of 0, a gamma value of 0.025 may be stored in an address of 1, a gamma value of 0.05 may be stored in an address of 2, a gamma value of 0.075 may be stored in an address of 3, and a gamma value of 0.7 may be stored in an address of 31. The second register 913 may output one of the gamma values as the second boost data G_BOOST, according to the second address signal REG_ADDR2.

The second boosting part 910 increases a gamma value of the input image data corresponding to the (N−1)-th gate line in consideration of the input image data corresponding to the (N−1)-th gate line and the input image data corresponding to the N-th gate line. For example, when the gamma value of the first input data R_IN corresponding to the (N−1)-th gate line is 0, the gamma value of the second input data G_IN corresponding to the (N−1)-th gate line is 0, the gamma value of the third input data B_IN corresponding to the (N−1)-th gate line is 0, the gamma value of the first input data R_IN corresponding to the N-th gate line is 31, the gamma value of the second input data G_IN corresponding to the N-th gate line is 31, and the gamma value of the third input data B_IN corresponding to the N-th gate line is 31, the second boosting part 910 increases the gamma value of the second input data G_IN corresponding to the (N−1)-th gate line according to the first input data R_IN corresponding to the N-th gate line and outputs the second boost data G_BOOST.

The second ACC part 320 is substantially the same as the second ACC part 320 of FIG. 4. Thus, when the gamma value of the second input data G_IN is not 0, the second ACC part 320 performs an ACC on the second input data G_IN according to the ACC data stored in the second ACC look-up table 323 and outputs the second ACC data G_ACC.

The second selector 330 is substantially the same as the second selector 330 of FIG. 4. Thus, the second selector 330 receives the second selection signal FLAG2, and selectively outputs the second boost data G_BOOST output from the second boosting part 910 and the second ACC data G_ACC output from the second ACC part 320, according to the second selection signal FLAG2. Specifically, when the second selection signal FLAG2 indicates that the gamma value of the second input data G_IN is 0, the second selector 330 outputs the second boosting data G_BOOST output from the second boosting part 910 as the second output data G_OUT. When the second selection signal FLAG2 indicates that the gamma value of the second input data G_IN is not 0, the second selector 330 outputs the second ACC data G_ACC output from the second ACC part 320 as the second output data G_OUT.

Referring to FIGS. 1 and 15, the third data processing part 1000 includes a third boosting part 1010, a third ACC part 420 and a third selector 430.

The third boosting part 1010 includes a third address generator 1011, a third register 1013 and a third line memory 1015.

The third address generator 1011 and the third line memory 1015 receive the input image data DATA_IN. The input image data DATA_IN may be image data for displaying a horizontal stripe pattern on the display panel 110.

The third line memory 1015 may sequentially store and output the input image data corresponding to the (N−1)-th gate line and the input image data corresponding to the N-th gate line. Here, the (N−1)-th gate line may be the first gate line GL1 of FIG. 6 and the N-th gate line may be the second gate line GL2 of FIG. 6.

The third address generator 1011 receives the input image data corresponding to the (N−1)-th gate line and the input image data corresponding to the N-th gate line, and outputs a third address signal REG_ADDR3 according to the gamma values of the input image data corresponding to the (N−1)-th gate line and the input image data corresponding to the N-th gate line. In addition, the third address generator 1011 may output a third selection signal FLAG3 indicating whether the gamma value of the third input data B_IN is 0. For example, when the gamma value of the third input data B_IN is 0, the third selection signal FLAG3 may have a high level, and when the gamma value of the third input data B_IN is not 0, the third selection signal FLAG3 may have a low level.

The third register 1013 has several entries to store gamma values. Each entry includes one of the gamma values and a corresponding address. For example, a gamma value of 0 may be stored in an address of 0, a gamma value of 0.025 may be stored in an address of 1, a gamma value of 0.05 may be stored in an address of 2, a gamma value of 0.075 may be stored in an address of 3, and a gamma value of 0.7 may be stored in an address of 31. The third register 1013 may output one of the gamma values as the third boost data B_BOOST, according to the third address signal REG_ADDR3.

In an embodiment, the third boosting part 1010 increases a gamma value of the input image data corresponding to the (N−1)-th gate line in consideration of the input image data corresponding to the (N−1)-th gate line and the input image data corresponding to the N-th gate line. For example, when the gamma value of the first input data R_IN corresponding to the (N−1)-th gate line is 0, the gamma value of the second input data G_IN corresponding to the (N−1)-th gate line is 0, the gamma value of the third input data B_IN corresponding to the (N−1)-th gate line is 0, the gamma value of the first input data R_IN corresponding to the N-th gate line is 31, the gamma value of the second input data G_IN corresponding to the N-th gate line is 31, and the gamma value of the third input data B_IN corresponding to the N-th gate line is 31, the third boosting part 1010 increases the gamma value of the third input data B_IN corresponding to the (N−1)-th gate line according to the second input data G_IN corresponding to the N-th gate line and outputs the third boost data B_BOOST.

The third ACC part 320 is substantially the same as the third ACC part 420 of FIG. 5. Thus, when the gamma value of the third input data B_IN is not 0, the third ACC part 420 performs an ACC on the third input data B_IN according to the ACC data stored in the third ACC look-up table 423 and outputs the third ACC data B_ACC.

The third selector 430 is substantially the same as the third selector 430 of FIG. 5. Thus, the third selector 430 receives the third selection signal FLAG3, and selectively outputs the third boost data B_BOOST output from the third boosting part 1010 and the third ACC data B_ACC output from the third ACC part 420, according to the third selection signal FLAG3. Specifically, when the third selection signal FLAG3 indicates that the gamma value of the third input data B_IN is 0, the third selector 430 outputs the third boosting data B_BOOST output from the third boosting part 1010 as the third output data B_OUT. When the third selection signal FLAG3 indicates that the gamma value of the third input data B_IN is not 0, the third selector 430 outputs the third ACC data B_ACC output from the third ACC part 420 as the third output data B_OUT.

According to the present exemplary embodiment, although the gamma values of the input image data corresponding to the (N−1)-th gate line are 0, the first data processing part 800, the second data processing part 900 and the third data processing part 1000 increase the gamma value of the input image data corresponding to the (N−1)-th gate line, according to the gamma value of the input image data corresponding to the N-th gate line. Therefore, a charge rate of which data is charged in a pixel may be increased. Thus, display quality of the display apparatus 100 may be improved.

According to a display panel driving apparatus, a method of driving a display panel using the display panel driving apparatus, and a display apparatus having the display panel driving apparatus are presented. When at least one of a gamma value of first input data, a gamma value of second input data and a gamma value of third input data is 0, a data processing part increases the gamma value of the input data of which the gamma value is 0, and thus a charge rate at which data is charged in a pixel may be increased. In addition, the data processing part gradually increases the gamma value of the input data of which the gamma value is 0, according to a gamma value of the input data of which the gamma value is not 0, and thus a side luminance difference of the display panel may be decreased. Thus, display quality of the display apparatus may be improved.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the present inventive concept. Accordingly, all such modifications are intended to be included within the scope of the present inventive concept.

What is claimed is:

1. A display panel driving apparatus comprising:

a data processing circuit configured to increase a first gamma value associated with input image data according to a second gamma value associated with the input image data when the first gamma value is 0 and the second gamma value is not 0, and adjust the input image data using the increased first gamma value and the second gamma value to output image data including first output data, second output data and third output data;

a data driver configured to output a data signal based on the output image data to a data line of a display panel; and a gate driver configured to output a gate signal to a gate line of the display panel, wherein the data processing circuit increases the first gamma value by multiplying the second gamma value by a pre-defined value to obtain a result and setting the increased first gamma value to the result.

2. The display panel driving apparatus of claim 1, wherein the input image data comprises red input data, green input data, and blue input data, the first output data is red output data, the second output data is green output data, and the third output data is blue output data.

3. The display panel driving apparatus of claim 1, wherein the input image data comprises first input data, second input data, and third input data, and when a gamma value associated with the first input data is 0, a gamma value associated with the second input data is 0 and a gamma value associated with the third input data is not 0, the data processing circuit increases the gamma value of the first input data according to the gamma value of the third input data.

4. The display panel driving apparatus of claim 1, wherein the input image data comprises first input data, second input data, and third input data, and when a gamma value associated with the first input data is 0, a gamma value associated with the second input data is not 0 and a gamma value associated with the third input data is not 0, the data processing circuit increases the gamma value of the first input data according to the gamma value of the second input data and the gamma value of the third input data.

5. The display panel driving apparatus of claim 1, wherein the input image data comprises first input data, second input data, and third input data, and when a gamma value associated with the first input data is 0, a gamma value associated with the second input data is 0 and a gamma value associated with the third input data is 0, the data processing circuit maintains the gamma value of the first input data.

6. The display panel driving apparatus of claim 1, wherein the data processing circuit comprises:

a first data processing circuit configured to receive the input image data and output the first output data;

a second data processing circuit configured to receive the input image data and output the second output data; and a third data processing circuit configured to receive the input image data and output the third output data.

7. The display panel driving apparatus of claim 6, wherein the input image data comprises first input data, second input data, and third input data, wherein the first data processing circuit comprises a first boosting circuit increasing a gamma value associated with the first input data according to a gamma value of the second input data and a gamma value associated with the third input data to output first boost data, when the gamma value associated with the first input data is 0.

8. The display panel driving apparatus of claim 7, wherein the first boosting circuit comprises:

a first address generator configured to receive the input image data and output a first address signal according to the gamma value associated with the second input data and the gamma value associated with the third input data when the gamma value associated with the first input data is 0; and a first register having entries configured to store gamma values and corresponding addresses and output one of the gamma values according to the first address signal, as the first boost data.

9. The display panel driving apparatus of claim 6, wherein the input image data comprises first input data, second input data, and third input data, wherein the second data processing circuit comprises a second boosting circuit increasing a gamma value associated with the second input data according to a gamma value associated with the first input data and a gamma value associated with the third input data to output second boost data, when the gamma value associated with the second input data is 0.

10. The display panel driving apparatus of claim 9, wherein the second boosting circuit comprises:

a second address generator configured to receive the input image data and output a second address signal according to the gamma value associated with the first input data and the gamma value associated with the third input data when the gamma value associated with the second input data is 0; and a second register having entries configured to store gamma values and corresponding addresses and output one of the gamma values according to the second address signal, as the second boost data.

11. The display panel driving apparatus of claim 6, wherein the input image data comprises first input data, second input data, and third input data, wherein the third data processing circuit comprises a third boosting circuit increasing a gamma value associated with the third input data according to a gamma value associated with the first input data and a gamma value associated with the second input data to output third boost data, when the gamma value associated with the third input data is 0.

12. The display panel driving apparatus of claim 11, wherein the third boosting circuit comprises:

a third address generator configured to receive the input image data and output a third address signal according to the gamma value associated with the first input data and the gamma value associated with the second input data when the gamma value associated with the third input data is 0; and a third register having entries configured to store gamma values and corresponding addresses and output one of the gamma values according to the third address signal, as the third boost data.

13. The display panel driving apparatus of claim 6, wherein the input image data comprises first input data, second input data, and third input data, and wherein the first data processing circuit comprises first boosting circuits having first registers according to areas of the display panel and increasing a gamma value associated with the first input data according to gamma values stored in the first registers, respectively, to output first boosting data.

14. The display panel driving apparatus of claim 6, the input image data comprises first input data, second input data, and third input data, and wherein the second data processing circuit comprises second boosting circuits having second registers according to areas of the display panel and increasing a gamma value associated with the second input data according to gamma values stored in the second registers, respectively, to output second boosting data.

15. The display panel driving apparatus of claim 1, wherein the data processing circuit further comprises a line memory to sequentially store and output input image data corresponding to a first gate line and input image data corresponding to a second adjacent gate line, among the input image data.

16. A method of driving a display panel, the method comprising:

increasing a first gamma value associated with input image data according to a second gamma value associated with the input image data when the first gamma value is 0 and the second gamma value is not 0, and adjust the input image data using the increased first gamma value and the second gamma value to output image data including first output data, second output data and third output data;

outputting a data signal based on the output image data to a data line of the display panel; and outputting a gate signal to a gate line of the display panel, wherein the increasing comprises increasing the first gamma value by multiplying the second gamma value by a pre-defined value to obtain a result and setting the increased first gamma value to the result.

17. A display apparatus comprising:

a display panel including a data line and a gate line; and a display panel driving apparatus comprising:

a gate driver configured to output a gate signal to the gate line;

a data processing circuit configured to increase a first gamma value of first input data, according to a second gamma value of second input data and a third gamma value of third input data, when the first gamma value is 0, the second gamma value is non-zero, and the third gamma value is non-zero, to output image data including first output data, second output data and third output data; and a data driver configured to output a data signal based on the output image data output from the data processing circuit to the data line, wherein input image data comprising the first input data, the second input data, and the third input data is input to the data processing circuit, wherein the first gamma value is increased by averaging the second gamma value with the third gamma value to obtain a first result, multiplying the first result by a pre-defined value to obtain a second result and setting the increased first gamma value to the second result.

* * * * *